US006034486A

United States Patent [19]

Fukui

[11] Patent Number: 6,034,486

[45] **Date of Patent: *Mar. 7, 2000**

[54] ELECTRONIC FLASH DEVICE

[75] Inventor: Hajime Fukui, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/995,396

[22] Filed: Dec. 22, 1997

[30] Foreign Application Priority Data

Dec. 25, 1996 [JP] Japan ..... 8-355856
Dec. 27, 1996 [JP] Japan ..... 8-356701

[51] Int. Cl.[7] ..... H05B 37/00

[52] U.S. Cl. ..... 315/241 P; 315/241 S; 315/241 R; 396/156

[58] Field of Search ..... 315/241 P, 241 S, 315/238, 241 R; 396/156, 205, 206

[56] References Cited

U.S. PATENT DOCUMENTS 4,288,722 9/1981 Ikawa ..... 315/151
4,485,336 11/1984 Yoshiyama et al. ..... 315/241 P
5,038,080 8/1991 Hirata ..... 315/241 P
5,640,620 6/1997 Matsui ..... 396/156
5,668,445 9/1997 Matsui ..... 315/241 P

OTHER PUBLICATIONS

Patent Abstracts of Japan No. JP 07 037693 A, published Feb. 7, 1995.

Patent Abstracts of Japan No. JP 07 037694 A, published Feb. 7, 1995.

Patent Abstracts of Japan No. JP 07 263167 A, published Oct. 13, 1995.

*Primary Examiner*—Haissa Philogene
*Attorney, Agent, or Firm*—Robin, Blecker & Daley

[57] ABSTRACT

The present invention relates to an electronic flash device which, even if the charged voltage of a main capacitor is low, can securely effect a trigger operation by making a trigger voltage higher than the charged voltage of the main capacitor.

18 Claims, 12 Drawing Sheets

MAIN CAPACITOR VOLTAGE
t0
t2

CHG CURRENT
t1

POSITIVE TERMINAL VOLTAGE OF Xe TUBE

NEGATIVE TERMINAL VOLTAGE OF VOLTAGE DOUBLING CAPACITOR

X INPUT
t3

CLK INPUT
t4

DV OUTPUT

GATE OUTPUT

QC OUTPUT

CASE WHERE MAIN CAPACITOR VOLTAGE IS LOW

CASE WHERE MAIN CAPACITOR VOLTAGE IS HIGH

MAIN CAPACITOR VOLTAGE
t0

CHG TERMINAL CURRENT
t1

EMISSION OF Xe TUBE

+2VMC
ANODE VOLTAGE OF Xe TUBE OR POSITIVE TERMINAL VOLTAGE OF C 119

+ 1.nVMC
POSITIVE TERMINAL VOLTAGE OF C 111 OR POSITIVE TERMINAL VOLTAGE OF C 119

X INPUT

DV OUTPUT
t2

GATE OUTPUT
t3

CLK INPUT
t4

QC OUTPUT

ELECTRONIC FLASH DEVICE

BACKGROUND OF THE INVENTION

1. Field of the Invention

The present invention relates to an electronic flash device which includes a first capacitor capable of storing the electrical energy required for emission means to effect an emission, and a second capacitor additionally connected to the first capacitor.

2. Description of Related Art

An electronic flash device is arranged to apply a charged voltage of several hundred volts stored in a main capacitor across a xenon tube (hereinafter referred to as the Xe tube) which constitutes emission means, and at the same time apply a trigger voltage of several thousand volts to a trigger electrode of the Xe tube, to excite the Xe tube to cause it to effect an emission. However, if the voltage of the main capacitor is low, it becomes impossible to cause the Xe tube to effect an emission by the application of a trigger voltage below a predetermined voltage, depending on the characteristics of the Xe tube. This predetermined voltage is hereinafter referred to as the emission starting voltage.

The emission starting voltage is determined by conditions such as the tube diameter and the arc characteristics of the Xe tube and the pressure of xenon gas, and is approximately 250 volts in the case of general Xe tubes employed in small-sized cameras. If the emission starting voltage is high, the electronic flash device cannot effect an emission until the voltage of the main capacitor becomes fully high, so that the charging of the main capacitor takes time and the response speed of shooting becomes inferior.

To solve the above problem, it has heretofore been proposed to use a circuit provided with a capacitor for applying a voltage for lowering the negative terminal voltage of a Xe tube to a ground level or below at the time of start of an emission. Such a known circuit which employs a voltage doubling capacitor and an insulated gate bipolar transistor (hereinafter referred to as IGBT) has been disclosed in Japanese Laid-Open Patent Application No. Sho 64-17033.

FIG. 6 is a circuit diagram showing the essential portion of a circuit illustrated in Japanese Laid-Open Patent Application No. Sho 64-17033. The shown circuit includes a main capacitor 200 for storing the energy required for emission and is charged by a power source (not shown), a coil 201, a diode 202, a Xe tube 203, resistors 204 and 205, a voltage doubling capacitor 206, a diode 207, a resistor 208 and an IGBT 209. If a voltage of high level is applied to a gate electrode GATE from a control circuit (not shown), the collector and the emitter of the IGBT 209 are electrically connected to each other, whereas if a voltage of low level is applied to the gate electrode GATE, the collector and the emitter of the IGBT 209 are electrically disconnected from each other.

In the above-described circuit, if the main capacitor 200 is charged by the power source (not shown), the voltage doubling capacitor 206 is charged in the shown polarity through the resistors 204 and 208. During an emission, a trigger circuit (not shown) applies a voltage of several thousand volts to a trigger electrode TRIG of the Xe tube 203 and at the same time applies a voltage of high level to the gate electrode GATE of the IGBT 209, thereby electrically connecting the emitter and the collector of the IGBT 209. At this time, the positive terminal (anode) of the voltage doubling capacitor 206 is lowered to a ground potential through the resistor 205 and the IGBT 209, so that a negative voltage is generated on the negative terminal (cathode) side of the voltage doubling capacitor 206 and the negative voltage is applied to the negative terminal side of the Xe tube 203. Thus, a voltage which is twice the charged voltage of the main capacitor 200 is applied across the Xe tube 203.

Another circuit which applies a higher voltage to the Xe tube 203 at the time of start of an emission by using a plurality of doubled voltage applying circuits of the above-described type is disclosed in Japanese Laid-Open Patent Application No. Hei 4-306594.

The conventional example disclosed in Japanese Laid-Open Patent Application No. Sho 64-17033 is arranged in such a manner that the voltage doubling capacitor 206 is charged through the resistor 204 and the resistor 208. If the Xe tube 203 needs to be made to effect an emission repeatedly at a high speed, the voltage doubling capacitor 206 needs to be charged at a high speed for each emission. However, if the resistance value of the resistor 208 is made small to reduce the charging time of the voltage doubling capacitor 206, an emission current will flow through the resistor 208 even when the IGBT 209 is turned off at the time of stop of an emission, so that the emission will not be stopped. It is, therefore, impossible to reduce the resistance value of the resistor 208 to approximately 100 KΩ or below. For this reason, in this conventional example, it is difficult to charge the voltage doubling capacitor 206 at a high speed and hence, it is impossible to cope with a high-speed repeated emission.

The conventional example disclosed in Japanese Laid-Open Patent Application No. Hei 4-306594, which is provided with a plurality of doubled voltage applying circuits, effectively works if the voltage of the main capacitor is low. However, if the voltage of the main capacitor is high, there is the problem that a voltage higher than necessary is applied across the Xe tube to adversely affect the durability, the wiring and the like of the Xe tube.

The electronic flash device shown in FIG. 7 is another known example. This device includes constituent elements such as a main capacitor 300 to be charged by a high voltage power source (not shown), a trigger capacitor 302 to be charged by the power source through a resistor 301, a trigger transformer 307 for applying a high voltage across a Xe tube 310 at the time of an emission, a thyristor 304 for trigger control, an IGBT 312 for emission control, and a voltage doubling capacitor 313 for applying a voltage which is twice the charged voltage of the main capacitor 300, across the Xe tube 310 during an emission.

In operation, the main capacitor 300 is charged through the high voltage power source (such as a DC/DC converter which is not shown), and the trigger capacitor 302 is also charged in the shown polarity up to the same voltage as the main capacitor 300 through the resistor 301. At the same time, the voltage doubling capacitor 313 is also charged up to the same voltage as the main capacitor 300 through the resistor 301, the diode 303 and the resistor 315.

In the case of emission, when a signal of high level is applied to the gate of the thyristor 304, the thyristor 304 is turned on, and the electric charge of the trigger capacitor 302 flows through the thyristor 304 and the trigger transformer 307 so that a high voltage is generated on the secondary winding side of the trigger transformer 307 to excite the Xe tube 310. At the same time, when a signal of high level is applied to the gate of the IGBT 312 to turn on the IGBT 312, the Xe tube 310 starts an emission.

During the emission, since the positive terminal of the voltage doubling capacitor 313 is grounded through the thyristor 304, the positive terminal potential of the voltage doubling capacitor 313 becomes zero and the negative terminal potential of the voltage doubling capacitor 313 becomes a negative potential. Accordingly, letting Vmc be the voltage of the main capacitor 300, the cathode potential of the Xe tube 310 is −Vmc and the anode potential of the Xe tube 310 is Vmc, i.e., a voltage which is twice the charged voltage of the main capacitor 300 is applied across the Xe tube 310, so that even if the voltage of the main capacitor 300 is low, the Xe tube 310 can readily effect an emission. When the emission is to be stopped, the gate of the IGBT 312 is set to a low level and the IGBT 312 is turned off to stop the emission of the Xe tube 310.

In the above-described conventional example, at the time of start of an emission, a voltage which is twice the voltage of the main capacitor 300 is applied across the Xe tube 310. However, the voltage of a trigger circuit which actually excites the Xe tube 310 is the same as the voltage of the main capacitor 300, and if the voltage of the main capacitor 300 is low, the voltage generated on the secondary winding side of the trigger transformer 307 also becomes low. This leads to what is called "lack of emission", i.e., the problem that the Xe tube 310 cannot effect an emission.

BRIEF SUMMARY OF THE INVENTION

In light of the above-described problem, in accordance with one aspect of the present invention, there is provided an electronic flash device which comprises a main capacitor to be charged by a power source circuit, a flash tube which discharges electricity with an electric charge stored in the main capacitor, a trigger capacitor to be charged by the power source circuit, a trigger circuit which applies a trigger signal to the flash tube by discharging an electric charge stored in the trigger capacitor into a coil of a trigger transformer, and a trigger voltage control circuit which makes a voltage of the trigger capacitor higher than a voltage of the main capacitor.

In accordance with another aspect of the present invention, there is provided an electronic flash device in which the trigger voltage control circuit includes a trigger voltage summing capacitor to be charged by the power source circuit and a switching element which connects in series the trigger voltage summing capacitor and the main capacitor, a terminal of the trigger voltage summing capacitor opposite to a terminal thereof which is connected to the main capacitor being connected to the trigger capacitor.

In accordance with another aspect of the present invention, there is provided an electronic flash device in which the trigger voltage control circuit includes a plurality of capacitors as the trigger capacitor to be charged by the power source circuit and switch means which connects in series the plurality of capacitors after the plurality of capacitors have been charged, the trigger voltage control circuit being arranged to apply to the trigger transformer a voltage obtained by summing up voltages of the plurality of capacitors connected in series.

In accordance with another aspect of the present invention, there is provided an electronic flash device which comprises a first charging path which serves as a charging path for effecting charging of said trigger capacitor, and a second charging path having a time constant smaller than a time constant of said first charging path, the second charging path being formed to serve as a charging path after an emission.

In accordance with another aspect of the present invention, there is provided an electronic flash device which comprises a plurality of capacitors to be individually charged by a power source circuit, a flash tube which discharges electricity with electric charges stored in the plurality of capacitors, a voltage application control circuit for applying a sum value of voltages of the capacitors to the flash tube, and an inhibiting circuit for inhibiting a voltage summing operation of the voltage application control circuit according to a charged voltage of the capacitors.

The above and other aspects and objects of the present invention will become apparent from the following detailed description of preferred embodiments of the present invention, taken in conjunction with the accompanying drawings.

DETAILED DESCRIPTION OF THE INVENTION

Preferred embodiments of the present invention will be described below with reference to the accompanying drawings.

First Embodiment

Figure 1:
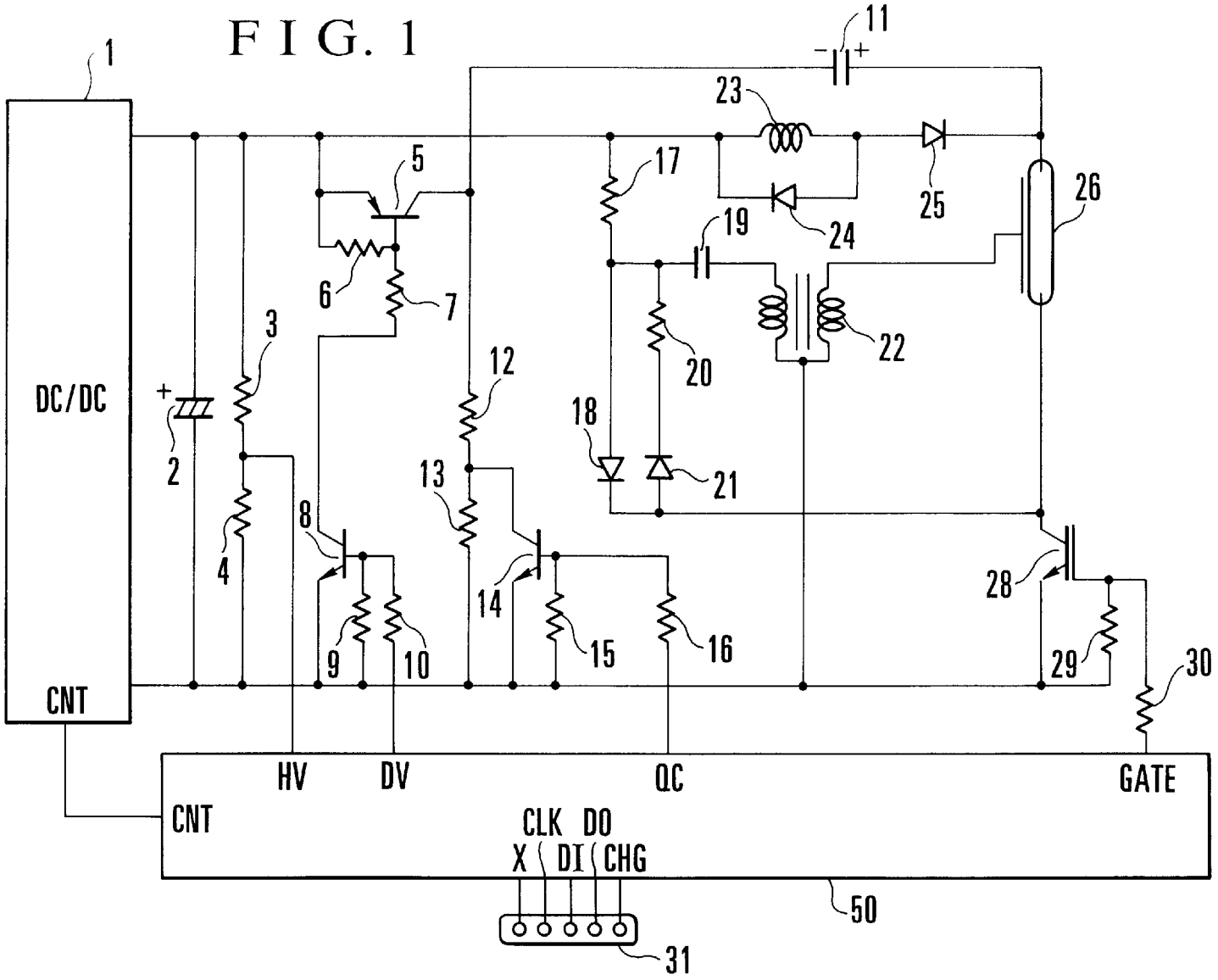
FIG. 1 is a circuit diagram showing the construction of an electronic flash device according to a first embodiment of the present invention.

FIG. 1 is a circuit diagram showing the construction of an electronic flash device according to a first embodiment of the present invention.

The electronic flash device shown in FIG. 1 includes a known DC/DC converter 1 capable of providing charging control through a terminal CNT and serving to boost a power source battery to several hundred volts to charge a main capacitor 2. The voltage of the main capacitor 2 is divided by resistors 3 and 4, and a microcomputer 50 which controls the operation of the entire electronic flash device detects the voltage of the main capacitor 2.

The electronic flash device also includes a PNP transistor 5, resistors 6 and 7, an NPN transistor 8, resistors 9 and 10 and a voltage doubling capacitor 11, and these elements 5 to 11 form a positive doubled voltage applying circuit. The electronic flash device also includes resistors 12 and 13, an NPN transistor 14 and resistors 15 and 16, and these elements 12 to 16 form a high-speed charging circuit for the voltage doubling capacitor 11. The electronic flash device also includes a resistor 17, a diode 18, a trigger capacitor 19, a resistor 20, a diode 21 and a trigger transformer 22, and these elements 17 to 22 form a trigger circuit. The electronic flash device also includes a coil 23 for limiting an emission current, a flywheel diode 24 for absorbing a voltage generated in the coil 23 when an emission is made to stop, a diode 25 for preventing interference with the doubled voltage applying circuit, a Xe tube 26 which constitutes emission means, an IGBT 28 which constitutes emission control means, resistors 29 and 30, and a contact terminal 31 for contact to a camera which is not shown.

Each terminal of the microcomputer 50 will be described below.

The microcomputer 50 includes the control output terminal CNT through which to control the charging operation of the DC/DC converter 1, an analog-to-digital conversion (A/D conversion) input terminal HV through which to monitor the voltage of the main capacitor 2, a voltage doubling operation control terminal DV, a rapid charging control output terminal QC through which to control the charging of the voltage doubling capacitor 11, and a gate control output terminal GATE through which to control the IGBT 28. The microcomputer 50 also includes an input terminal X through which to receive an emission instruction signal from the camera which is not shown, a serial clock input terminal CLK through which to perform well-known serial communications, a serial data input terminal DI, a serial data output terminal DO, and a current output terminal CHG through which to transmit to the camera a signal indicating whether the emission of the electronic flash device is possible. These terminals X, CLK, DI, DO and CHG are connected to a contact part of the camera through a contact terminal 31 so that the microcomputer 50 performs communications with the camera.

Figures 2A, 2B, 2C, 2D, 2E, 2F, 2G, 2H, 2I:
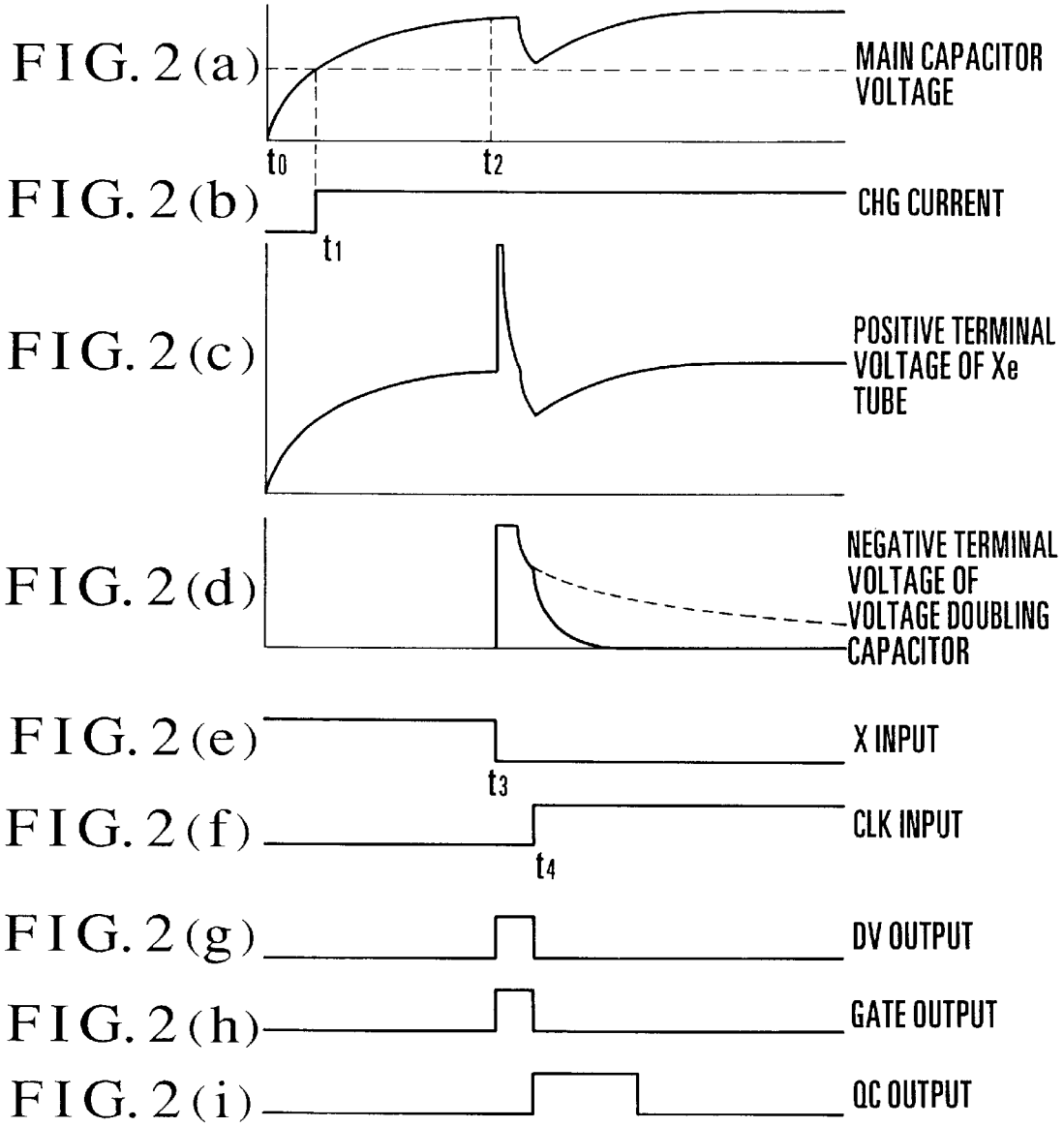
FIGS. 2(*a*) to 2(*i*) are timing charts aiding in describing a flash emission operation in the first embodiment of the present invention.

FIGS. 2(*a*) to 2(*i*) are timing charts showing the voltages of various portions in the electronic flash device shown in FIG. 1, and a flash emission operation will be described below with reference to FIGS. 2(*a*) to 2(*i*).

In the construction shown in FIG. 1, when a power switch which is not shown is turned on and the microcomputer 50 starts its operation at a time t0, the microcomputer 50 monitors the voltage of the main capacitor 2 through the terminal HV. If the voltage of the main capacitor 2 is lower than a predetermined voltage, the microcomputer 50 instructs the DC/DC converter 1 to perform a charging operation, through the terminal CNT. As shown in FIG. 2(*a*), the voltage of the main capacitor 2 starts to rise at the time of start of charging. In the meantime, the voltage doubling capacitor 11 is charged through the coil 23, the diode 25 and the resistors 12 and 13, and the potential at the positive terminal of the voltage doubling capacitor 11 becomes equal to the voltage of the main capacitor 2. As shown in FIG. 2(*d*), the potential at the negative terminal of the voltage doubling capacitor 11 is fixed to a ground potential before emission.

Then, at a time t1, if the voltage of the main capacitor 2 reaches a predetermined voltage at which emission is possible, the microcomputer 50 makes a predetermined current to flow out through the terminal CHG to inform the camera (not shown) that an emission has become possible. Then, at a time t2, if the voltage of the main capacitor 2 reaches an upper charged voltage, the microcomputer 50 instructs the DC/DC converter 1 to stop the charging operation, through the terminal CNT. Incidentally, even after the charging operation of the DC/DC converter 1 is stopped, a current continues to flow through elements such as the resistors 3 and 4 for monitoring the voltage of the main capacitor 2, and hence, the voltage of the main capacitor 2 lowers. For this reason, the microcomputer 50 again operates the DC/DC converter 1 through the terminal CNT and performs control to maintain the predetermined voltage.

Then, at a time t3, if a shutter button of the camera (not shown) is pressed and the terminal X is set to a low level (refer to FIG. 2(*e*)), the microcomputer 50 detects that fact and starts the following flash emission operation.

First, the output terminal DV is set to a high level as shown in FIG. 2(*g*). At this time, the NPN transistor 8 is brought into an electrically conductive state and the base current of the PNP transistor 5 flows into the NPN transistor 8 through the resistor 7, whereby the PNP transistor 5 is brought into an electrically conductive state. At this time, the potential at the positive terminal of the main capacitor 2 is applied to the emitter of the PNP transistor 5 and the collector potential of the PNP transistor 5 is raised to approximately the same potential as the emitter potential. Thus, the negative terminal potential of the voltage doubling capacitor 11 is raised to the potential of the main capacitor 2, whereas the positive terminal potential of the voltage doubling capacitor 11, i.e., the positive terminal potential of the Xe tube 26 shown in FIG. 2(*c*), becomes a potential which is approximately twice the voltage of the main capacitor 2.

In addition, as shown in FIG. 2(*h*), the microcomputer 50 sets the output terminal GATE to a high level at the same time as the above-described operation. At this time, the IGBT 28 is brought into an electrically conductive state and the electric charge of the trigger capacitor 19 flows through the diode 18, the IGBT 28 and the trigger transformer 22, so that a trigger voltage of several thousand volts is generated on the secondary winding side of the trigger transformer 22 to excite the Xe tube 26 to cause it to start an emission. At this emission starting time, as described above in connection with the aforesaid operation, the voltage obtained by summing up the voltage of the main capacitor 2 and the voltage of the voltage doubling capacitor 11, i.e., a voltage which is twice the voltage of the main capacitor 2, is applied across the Xe tube 26, whereby the Xe tube 26 can effect a stable emission.

An emission stop signal from the camera (not shown) is received by the microcomputer 50 when the terminal CLK is set to a high level at a time t4 as shown in FIG. 2(*f*). In response to the reception of the emission stop signal, the microcomputer 50 sets the output terminal GATE to a low level to set the IGBT 28 to an electrically non-conductive state, thereby stopping the emission. In addition, the microcomputer 50 sets the output terminal DV to a low level to set each of the NPN transistor 8 and the PNP transistor 5 to an electrically non-conductive state, thereby inhibiting the operation of the doubled voltage applying circuit.

Then, as shown in FIG. 2(*i*), the microcomputer 50 sets the output terminal QC to a high level for a predetermined time period to hold the NPN transistor 14 in an electrically conductive state. This setting is intended to rapidly charge the voltage doubling capacitor 11 for the next emission. FIG. 2(*d*) shows the charged state of the voltage doubling capacitor 11. After the completion of the emission, if the NPN transistor 14 is not brought into the electrically conductive state, as shown by a dotted line in FIG. 2(*d*), the negative terminal voltage of the voltage doubling capacitor 11 is charged in a time period determined by the capacity of the voltage doubling capacitor 11 and the time constants of the charging resistors 12 and 13. However, if the NPN transistor 14 is brought to the electrically conductive state, as shown by a solid line in FIG. 2(*d*), the negative terminal voltage of the voltage doubling capacitor 11 can be rapidly charged in accordance with a time constant determined by the capacity of the voltage doubling capacitor 11 and the charging resistor 12. Accordingly, even during a high-speed repeated emission, the voltage doubling capacitor 11 is fully charged and it is, therefore, possible to effect a stable emission operation without causing lack of emission.

In the above-described first embodiment, the control signal (DV) for the doubled voltage applying circuit and the control signal (GATE) for the IGBT 28 have described above as different signals, but both signals may also be formed as the same signal.

The above-described first embodiment is provided with means for connecting to the positive terminal of the main capacitor 2 the negative terminal of the voltage doubling capacitor 11 which is to be charged at the same time as the charging of the main capacitor 2, and the positive terminal of the voltage doubling capacitor 11 is connected to the positive terminal of the Xe tube 26 which constitutes the emission means. Accordingly, a voltage which is twice the voltage of the main capacitor 2 can be applied to the positive terminal of the Xe tube 26 which constitutes the emission means, and even if the voltage of the main capacitor 2 is low, it is possible to prevent lack of emission and hence to realize stable emission. (An electronic flash device having no such doubled voltage applying circuit cannot effect a sufficient emission as long as its charged voltage is less than 250 volts, but in the first embodiment, a charged voltage of approximately 200 volts suffices to ensure a sufficient emission.)

Furthermore, as described above, since the first embodiment is provided with the positive doubled voltage applying circuit and means for rapidly charging the aforesaid voltage doubling capacitor, the Xe tube can be made to stably emit even during a high-speed repeated emission.

Second Embodiment

In a second embodiment, the doubled voltage applying circuit for applying a positive high potential to the positive terminal of a Xe tube, which circuit has been described above in connection with the first embodiment, is combined with a doubled voltage applying circuit for applying a negative high potential to the negative terminal of a well-known Xe tube, so that the voltage to be applied across the Xe tube is varied according to the voltage of a main capacitor.

Figure 3:
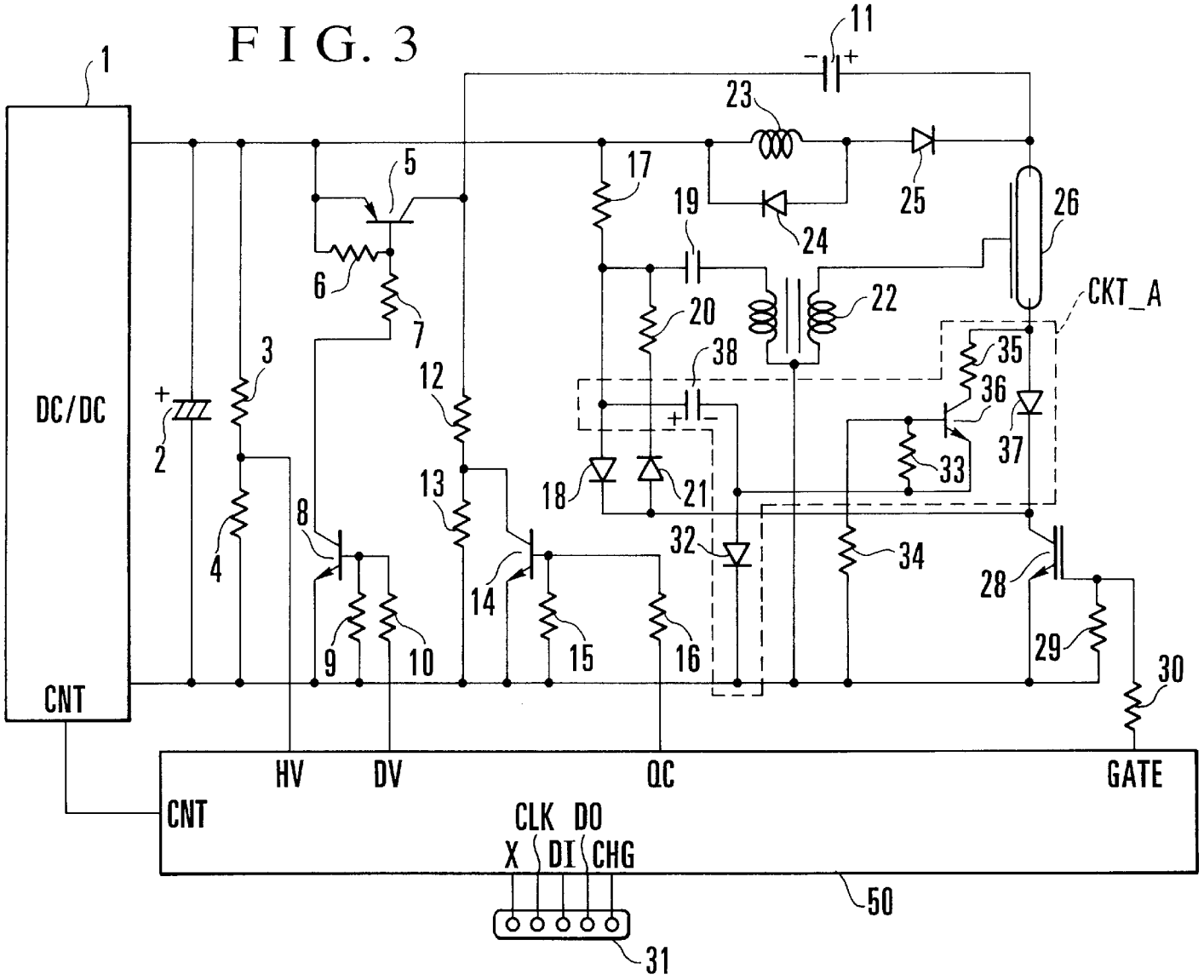
FIG. 3 is a circuit diagram showing the construction of an electronic flash device according to a second embodiment of the present invention.

FIG. 3 is a circuit diagram showing the construction of an electronic flash device according to the second embodiment of the present invention, and in FIG. 3, identical reference numerals are used to denote portions identical to those shown in FIG. 1.

The electronic flash device shown in FIG. 3 includes a known doubled voltage applying circuit CKT_A, a second voltage doubling capacitor 38, a diode 32 which forms a charging loop for the second voltage doubling capacitor 38, resistors 33, 34 and 35, a transistor 36 which connects the Xe tube 26 and the second voltage doubling capacitor 38 to each other at the time of an emission, and a diode 37.

The operation of the known negative doubled voltage applying circuit which is newly added in the above-described construction will be described below.

The output voltage of the DC/DC converter 1 is applied across the main capacitor 2 to charge the main capacitor 2, and the output voltage of the DC/DC converter 1 is also applied across the second voltage doubling capacitor 38 through the resistor 17 and the diode 32 so that the second voltage doubling capacitor 38 is charged in the shown polarity up to the same voltage as the main capacitor 2. During an emission, if the IGBT 28 is brought into the electrically conductive state, the positive terminal of the second voltage doubling capacitor 38 is lowered to a ground level via the IGBT 28, and a negative voltage equivalent to the voltage of the main capacitor 2 is relatively generated at the negative terminal of the second voltage doubling capacitor 38. At this time, since the base of the transistor 36 is grounded through the resistor 34, the emitter potential of the transistor 36 becomes lower than the base potential of the transistor 36 owing to the negative potential at the negative terminal of the second voltage doubling capacitor 38, so that the transistor 36 is brought into an electrically conductive state and a negative high potential is applied to the negative terminal of the Xe tube 26. Thus, a voltage which is twice the voltage of the main capacitor 2 is applied across the Xe tube 26.

Furthermore, a voltage which is twice the voltage of the main capacitor 2 is applied to the positive terminal of the Xe tube 26 by the positive doubled voltage applying circuit described above in connection with the first embodiment. Thus, a voltage which is three times the voltage of the main capacitor 2 is applied across the Xe tube 26.

In the second embodiment including the above-described negative doubled voltage applying circuit, the microcomputer 50 inhibits or enables the operation of the positive doubled voltage applying circuit according to the voltage of the main capacitor 2. If the voltage of the main capacitor 2 is lower than a predetermined voltage (180 to 120 volts), the microcomputer 50 drives both positive and negative doubled voltage applying circuits to apply across the Xe tube 26 a voltage which is three times the voltage of the main capacitor 2. If the voltage of the main capacitor 2 is higher than the predetermined voltage, the microcomputer 50 inhibits the positive doubled voltage applying circuit, thereby applying across the Xe tube 26 a voltage which is twice the voltage of the main capacitor 2.

The operation of the second embodiment when the voltage of the main capacitor 2 which is monitored by the microcomputer 50 through the terminal HV is lower than the predetermined voltage will be described below with reference to FIGS. 4(*a*) to 4(*i*).

When the power switch which is not shown is turned on and the microcomputer 50 starts its operation at a time t0, the microcomputer 50 monitors the voltage of the main capacitor 2 through the terminal HV. If the voltage of the main capacitor 2 is lower than the predetermined voltage, the microcomputer 50 instructs the DC/DC converter 1 to perform a charging operation, through the terminal CNT. As shown in FIG. 4(*a*), the voltage of the main capacitor 2 starts to rise at the time of start of charging. In the meantime, the voltage doubling capacitor 11 is charged through the coil 23, the diode 25 and the resistors 12 and 13, and the potential at the positive terminal of the voltage doubling capacitor 11 becomes equal to the voltage of the main capacitor 2. The potential at the negative terminal of the voltage doubling capacitor 11 is fixed to a ground potential before emission.

Then, at a time t5, if the voltage of the main capacitor 2 reaches a first predetermined voltage (approximately 150 volts) at which an emission is made possible by the operation of a tripled voltage applying circuit, the microcomputer 50 makes a predetermined current to flow out through the terminal CHG to inform the camera (not shown) that the emission has become possible.

Figure 4:
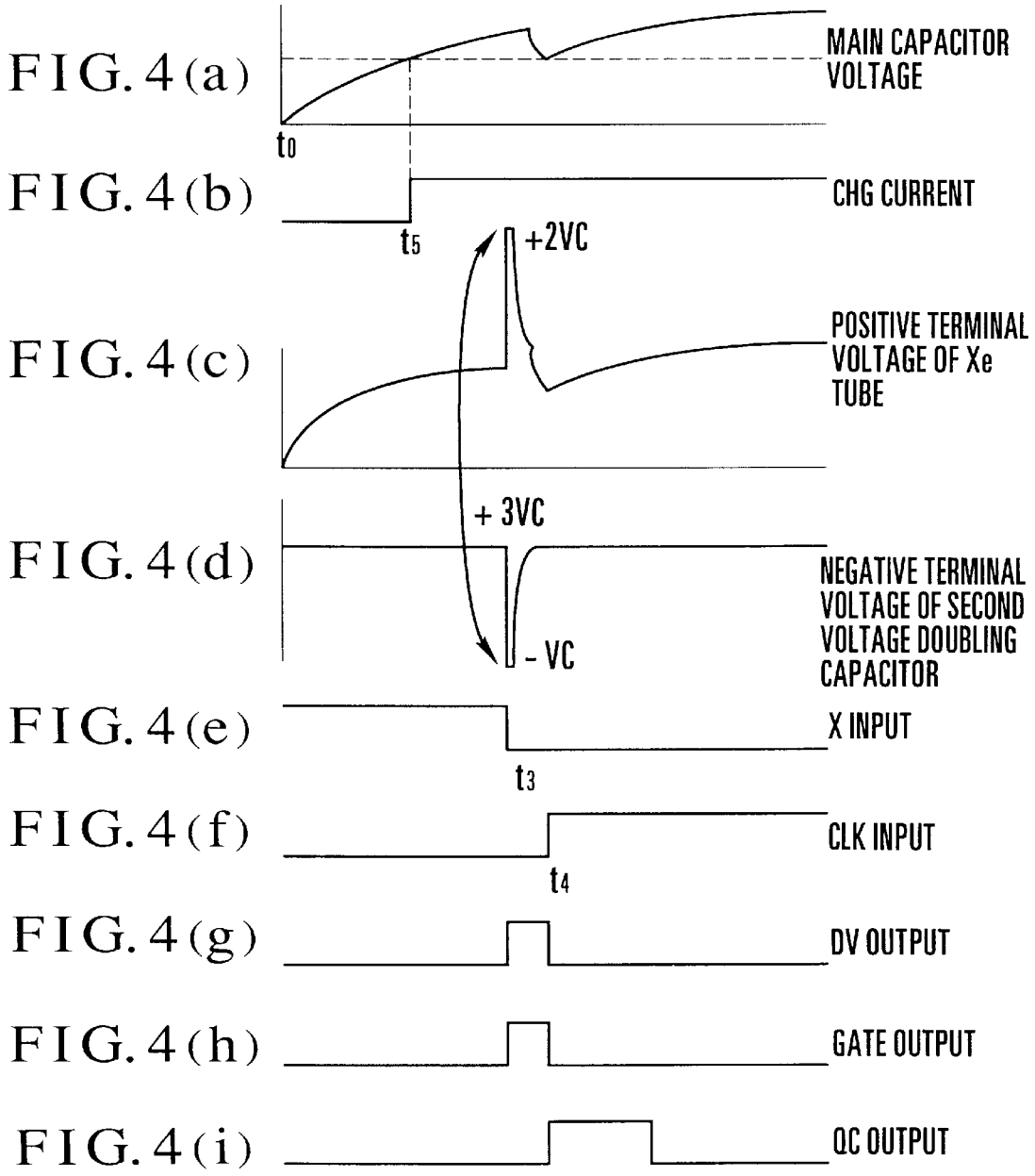
FIGS. 4(*a*) to 4(*i*) are a first set of timing charts aiding in describing a flash emission operation in the second embodiment of the present invention.

Then, at a time t3, if a shutter button of the camera (not shown) is pressed and the terminal X is set to a low level (refer to FIG. 4(*e*)), the microcomputer 50 detects that fact and starts the following flash emission operation.

First, if the voltage of the main capacitor 2 monitored by the microcomputer 50 through the terminal HV is lower than a predetermined voltage, the microcomputer 50 sets the output terminal DV to the high level as shown in FIG. 4(*g*) in order to operate the positive doubled voltage applying circuit. Then, the NPN transistor 8 is brought to the electrically conductive state and the base current of the PNP transistor 5 flows into the NPN transistor 8 through the resistor 7, whereby the PNP transistor 5 is brought into the electrically conductive state. At this time, the potential on the positive side of the main capacitor 2 is applied to the emitter of the PNP transistor 5 and the collector potential of the PNP transistor 5 is raised to approximately the same potential as the emitter potential. Thus, the negative terminal potential of the voltage doubling capacitor 11 is raised to the potential of the main capacitor 2, whereas the positive terminal potential of the voltage doubling capacitor 11, i.e., the positive terminal potential of the Xe tube 26 shown in FIG. 4(*c*), becomes a potential which is approximately twice the voltage of the main capacitor 2.

In addition, as shown in FIG. 4(*h*), the microcomputer 50 sets the output terminal GATE to the high level at the same time as the above-described operation. At this time, the IGBT 28 is brought into the electrically conductive state and the electric charge of the trigger capacitor 19 flows through the diode 18, the IGBT 28 and the trigger transformer 22, so that a trigger voltage of several thousand volts is generated on the secondary winding side of the trigger transformer 22 to excite the Xe tube 26.

Then, when the IGBT 28 is brought to the electrically conductive state, the positive terminal of the second voltage doubling capacitor 38 is grounded through the diode 18 and the IGBT 28 at the same time, and as described previously, the reverse voltage of the voltage of the main capacitor 2 is applied to the negative terminal of the Xe tube 26 through the transistor 36. Accordingly, at the emission starting time, as shown in FIG. 4(*c*), a voltage which is three times the voltage of the main capacitor 2 is applied across the Xe tube 26 so that an emission is started.

An emission stop signal from the camera (not shown) is received by the microcomputer 50 when the terminal CLK is set to the high level at a time t4 as shown in FIG. 4(*f*). In response to the reception of the emission stop signal, the microcomputer 50 sets the output terminal GATE to the low level to set the IGBT 28 to the electrically non-conductive state, thereby stopping the emission. In addition, the microcomputer 50 sets the output terminal DV to the low level to set each of the NPN transistor 8 and the PNP transistor 5 to the electrically non-conductive state, thereby inhibiting the operation of the doubled voltage applying circuit.

Then, as shown in FIG. 4(*i*), the microcomputer 50 sets the output terminal QC to the high level for a predetermined time period to hold the NPN transistor 14 in the electrically conductive state. This setting is intended to rapidly charge the voltage doubling capacitor 11 for the next emission.

At the time of stop of the emission, because the interior of the Xe tube 26 is ionized when the IGBT 28 is brought into the electrically non-conductive state, the internal resistance of the Xe tube 26 immediately after the stop of the emission is as low as several ohms and the voltage at the negative terminal of the Xe tube 26 is approximately equal to the voltage at the positive terminal of the Xe tube 26. Accordingly, a discharge current which has nowhere to flow as the result of the electrically non-conductive state of the IGBT 28 rapidly charges the second voltage doubling capacitor 38 and the trigger capacitor 19 through the diode 21 and the resistor 20. Accordingly, even during a high-speed repeated emission, both capacitors 38 and 19 are fully charged, and it is, therefore, possible to effect a stable emission operation without causing lack of emission.

On the other hand, if the voltage of the main capacitor 2 is higher than a second predetermined voltage (in excess of approximately 150 volts) at which an emission is made possible by the operation of the doubled voltage applying circuit, the microcomputer 50 stops the operation of either one of the doubled voltage applying circuits, because if both doubled voltage applying circuits are operated, a voltage higher than necessary is applied across the Xe tube 26 to adversely affect the durability, the wiring and the like of the Xe tube 26. In the following description of the second embodiment, reference will be made to FIGS. 5(*a*) to 5(*i*) on the assumption that the operation of the positive doubled voltage applying circuit is inhibited. Incidentally, the operation of the electronic flash device before the time of start of an emission has been described previously in connection with the operation performed by the electronic flash device when the voltage of the main capacitor 2 is low, and the description of such operation is omitted.

Figure 5:
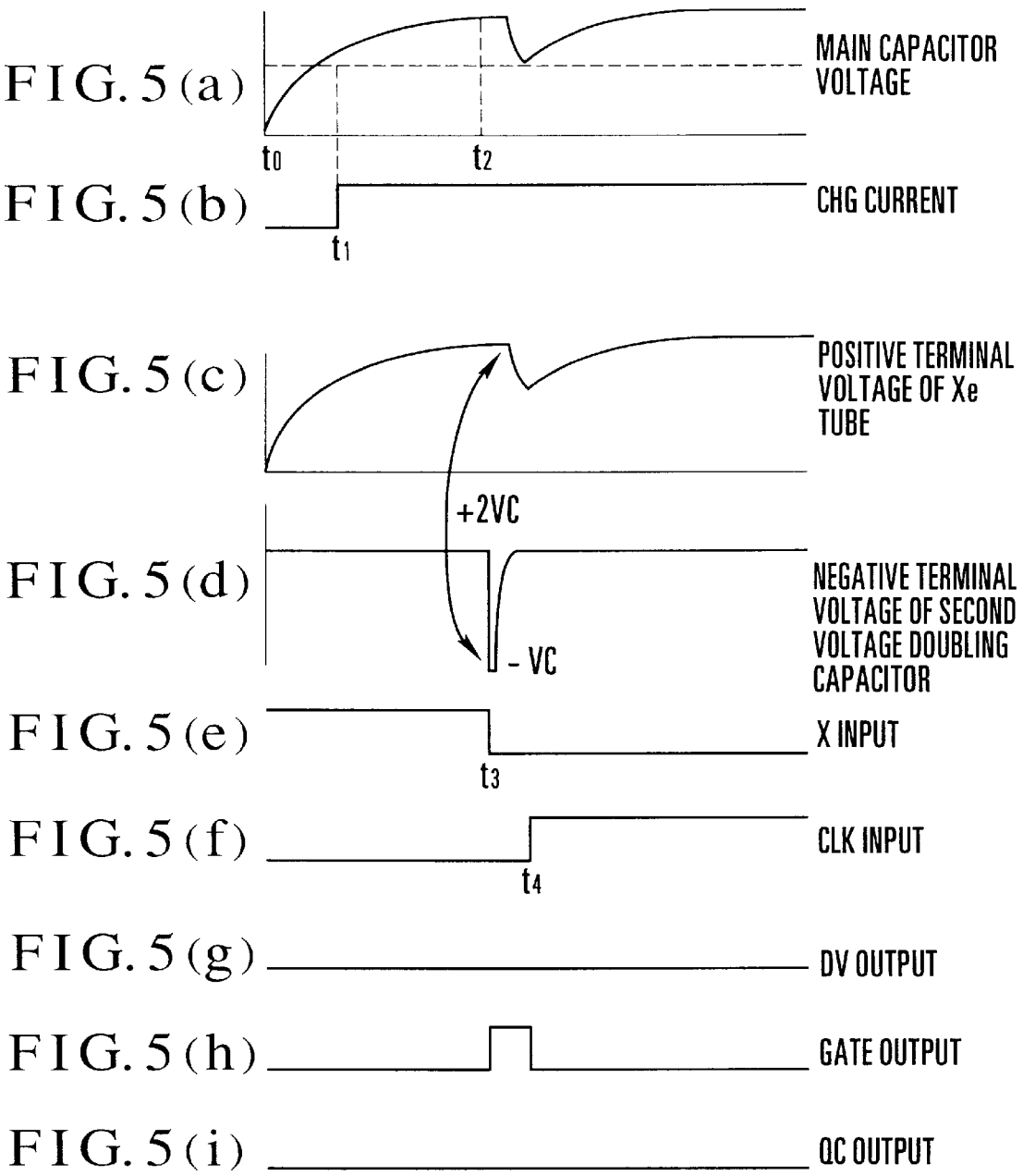
FIGS. 5(*a*) to 5(*i*) are a second set of timing charts aiding in describing the flash emission operation in the second embodiment of the present invention.
Figure 6:
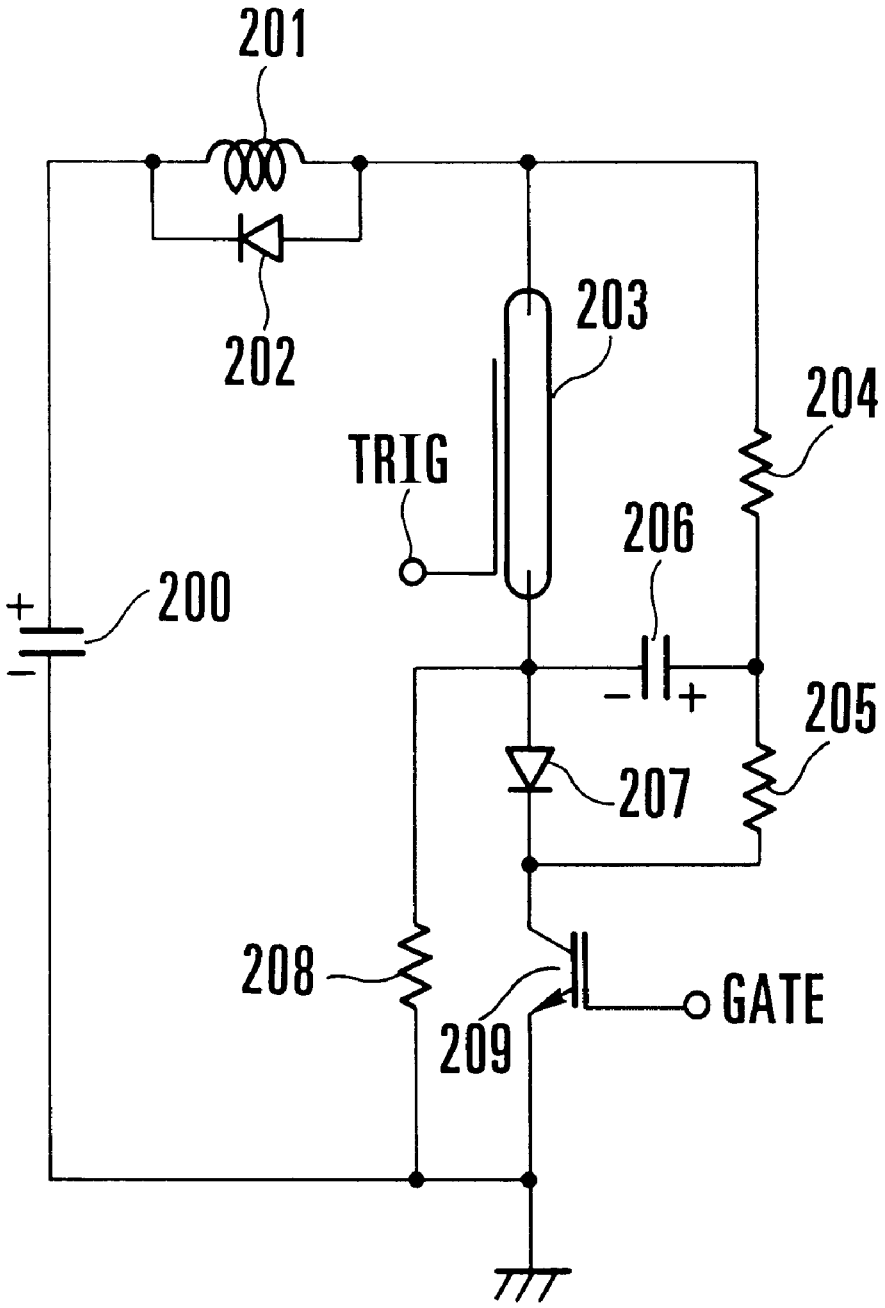
FIG. 6 (PRIOR ART)
FIG. 6 is a circuit diagram showing the construction of a conventional electronic flash device.
Figure 7:
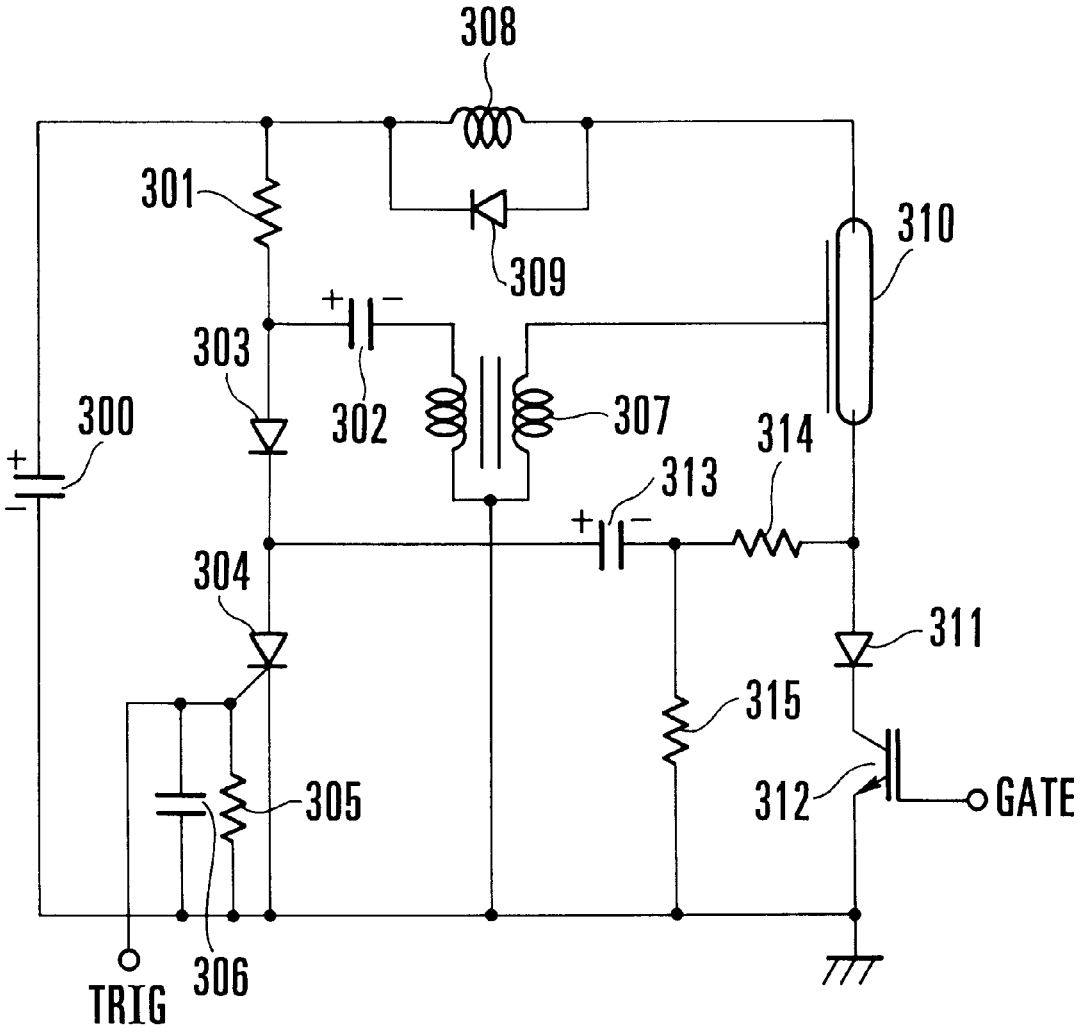
FIG. 7 (PRIOR ART)
FIG. 7 is a circuit diagram showing the construction of a conventional electronic flash device.

At a time t3, if the shutter button of the camera (not shown) is pressed and the terminal X is set to the low level (refer to FIG. 5(*e*)), the microcomputer 50 detects that fact and starts the following flash emission operation.

First, if the voltage of the main capacitor 2 monitored by the microcomputer 50 through the terminal HV is higher than the second predetermined voltage, the microcomputer 50 sets the output terminal GATE to the high level with the output terminal DV remaining at the low level, as shown in FIG. 5(*g*), in order to inhibit the operation of the positive doubled voltage applying circuit. Then, the IGBT 28 is brought to the electrically conductive state and the electric charge of the trigger capacitor 19 flows through the diode 18, the IGBT 28 and the trigger transformer 22, so that a trigger voltage of several thousand volts is generated on the secondary winding side of the trigger transformer 22 to excite the Xe tube 26.

Then, when the IGBT 28 is brought to the electrically conductive state, the positive terminal of the second voltage doubling capacitor 38 is grounded through the diode 18 and the IGBT 28 at the same time, and as described previously, the reverse voltage of the voltage of the main capacitor 2 is applied to the negative terminal of the Xe tube 26 through the transistor 36. Accordingly, at the emission starting time, as shown in FIG. 5(*c*), a voltage which is two times the voltage of the main capacitor 2 is applied across the Xe tube 26 so that an emission is started.

An emission stop signal from the camera (not shown) is received by the microcomputer 50 when the terminal CLK is set to the high level at a time t4 as shown in FIG. 5(*f*). In response to the reception of the emission stop signal, the microcomputer 50 sets the output terminal GATE to the low level to set the IGBT 28 to the electrically non-conductive state, thereby stopping the emission. At this time, because the interior of the Xe tube 26 is ionized, the internal resistance of the Xe tube 26 immediately after the stop of the emission is as low as several ohms and the voltage at the negative terminal of the Xe tube 26 is approximately equal to the voltage at the positive terminal of the Xe tube 26. Accordingly, a discharge current which has nowhere to flow as the result of the electrically non-conductive state of the IGBT 28 rapidly charges the second voltage doubling capacitor 38 and the trigger capacitor 19 through the diode 21 and the resistor 20. Accordingly, even during a high-speed repeated emission, the second voltage doubling capacitor 38 is fully charged, and it is, therefore, possible to effect a stable emission operation without causing lack of emission.

In the above-described second embodiment, the microcomputer 50 detects the state of voltage of the main capacitor 2, selects from a plurality of doubled voltage applying circuits according to the detected state of voltage, and determines a voltage to be applied to the Xe tube 26. Accordingly, the Xe tube 26 can be made to effect emission with high reliability and stability whether the voltage of the main capacitor 2 is high or low.

Although the second embodiment has been described with reference to an example provided with two doubled voltage applying circuits, a larger number of doubled voltage applying circuits may be provided so that the operation of each of the doubled voltage applying circuits is finely set according to the voltage of the main capacitor 2.

In addition, although in the second embodiment the two doubled voltage applying circuits include one positive doubled voltage applying circuit and one negative doubled voltage applying circuit, it is also possible to adopt a construction provided with only a plurality of positive doubled voltage applying circuits or only a plurality of negative doubled voltage applying circuits.

Third Embodiment

Figure 8:
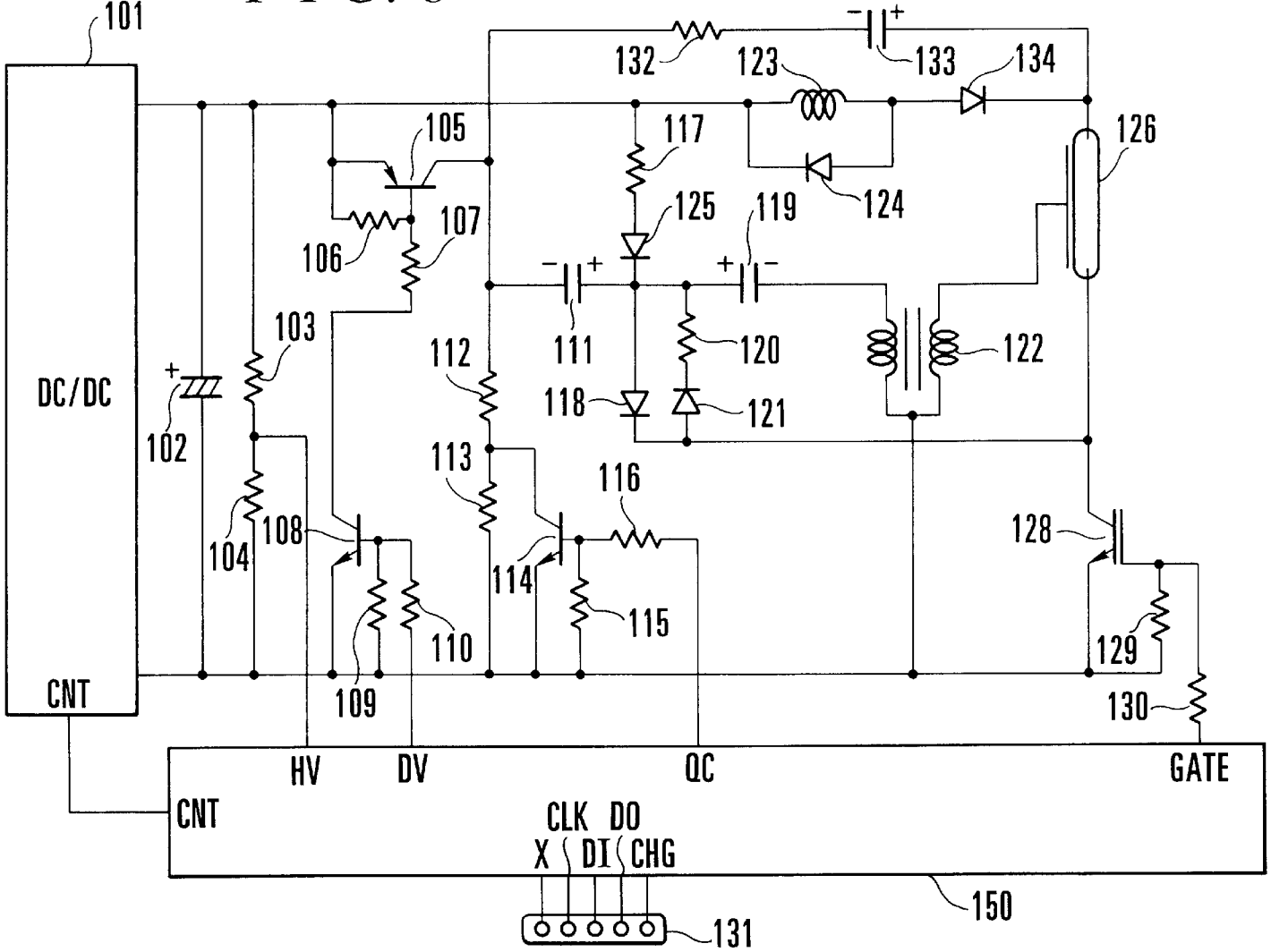
FIG. 8 is a block diagram of an electrical circuit of an electronic flash device according to a third embodiment of the present invention.
Figures 9A, 9B, 9C, 9D, 9E, 9F, 9G, 9H, 9I, 9J:
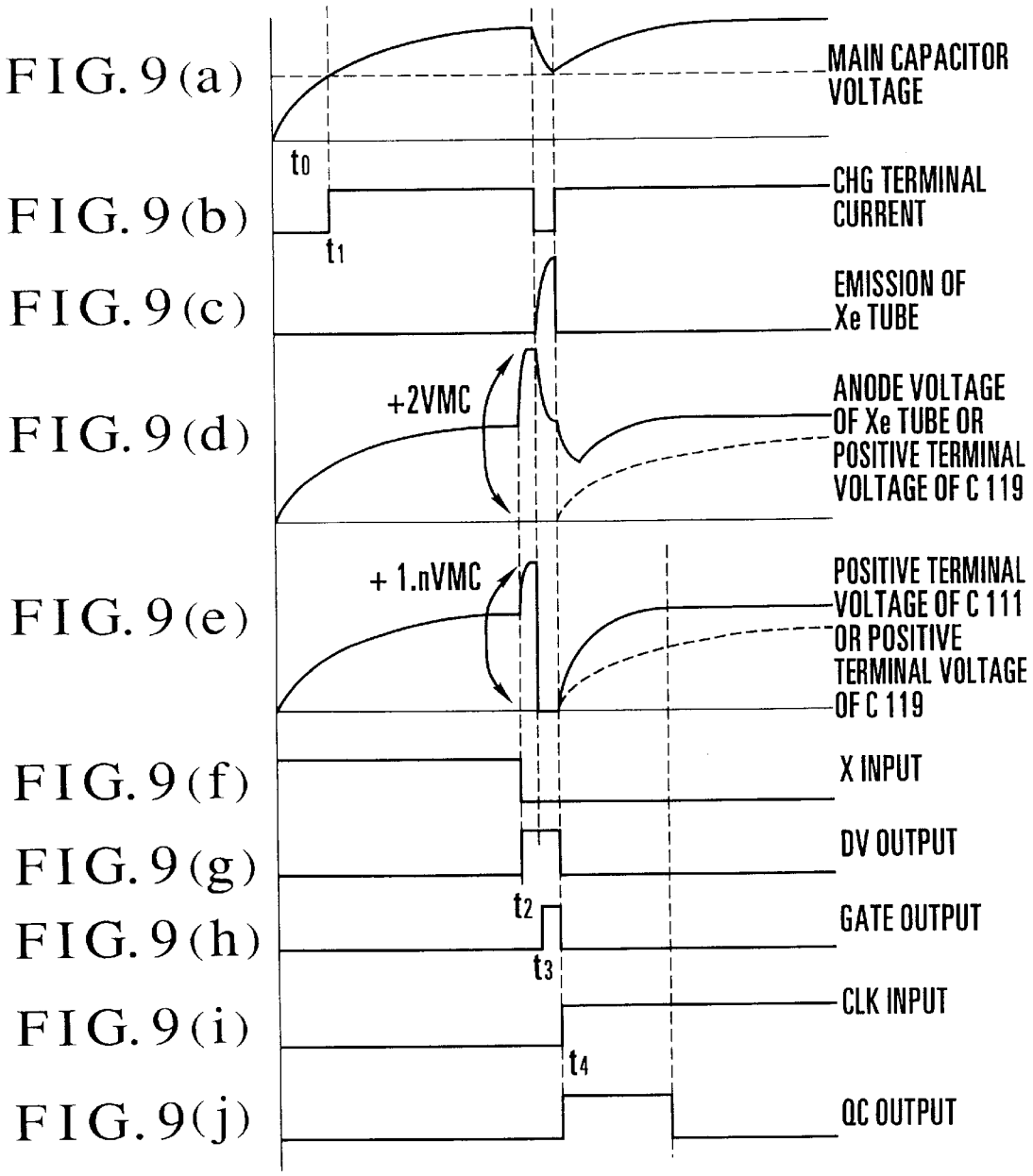
FIGS. 9(*a*) to 9(*j*) are timing charts of the operation of the electronic flash device shown in FIG. 8.
Figure 10:
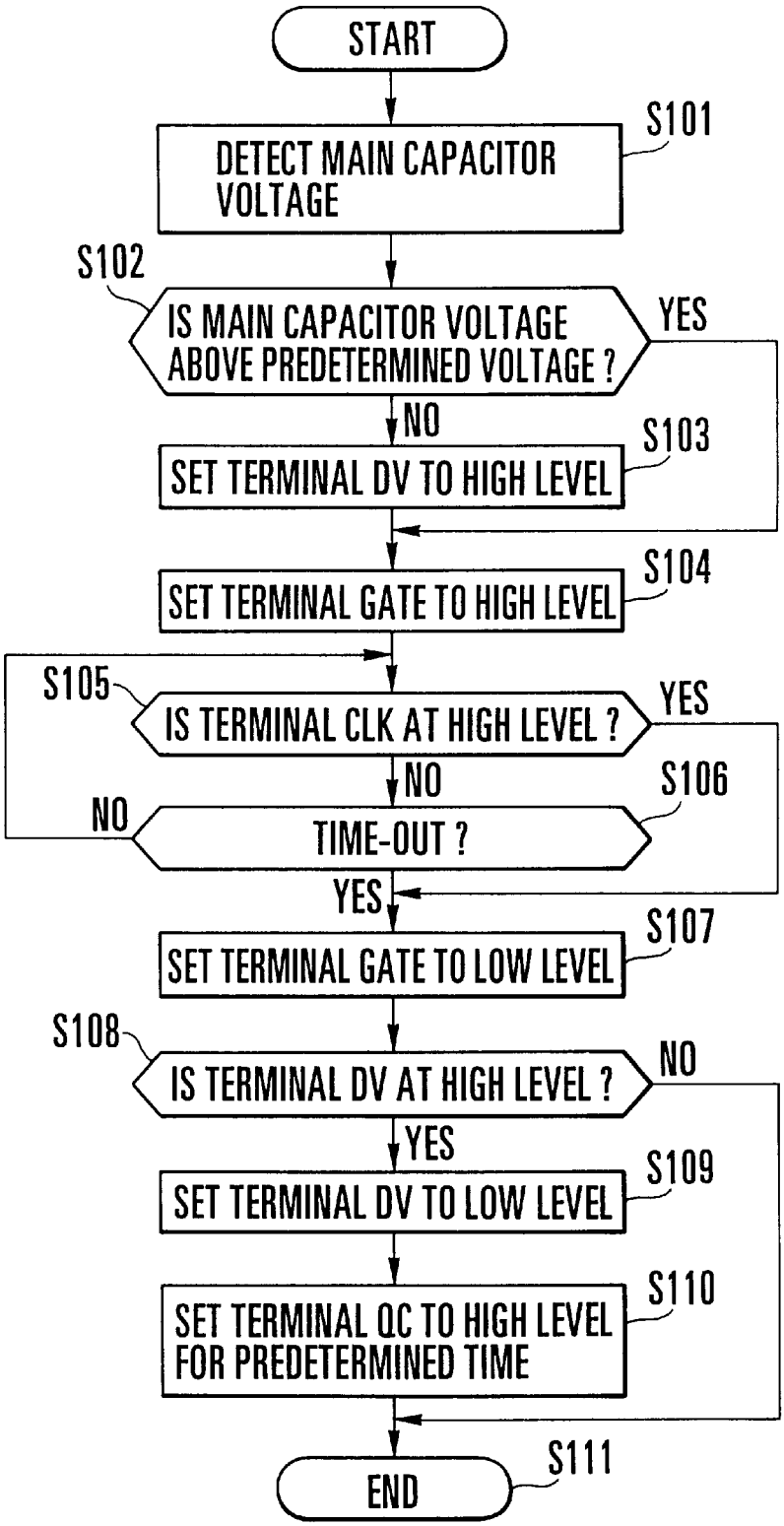
FIG. 10 is a flowchart of the operation of the electronic flash device shown in FIG. 8.

FIGS. 8 to 10 are views showing a third embodiment of the present invention.

FIG. 8 is a block diagram of an electrical circuit of an electronic flash device according to the third embodiment of the present invention.

FIGS. 9(*a*) to 9(*j*) are timing charts of the operation of the electronic flash device shown in FIG. 8.

FIG. 10 is a flowchart of the operation of the electronic flash device shown in FIG. 8.

The electronic flash device shown in FIG. 8 includes a known DC/DC converter 101 capable of providing charging control through a terminal CNT and serving to boost a power source battery to several hundred volts to charge a main capacitor 102. The voltage of the main capacitor 102 is divided by resistors 103 and 104, and a microcomputer 150 which controls the operation of the entire electronic flash device detects the divided voltage and performs charging control so that the main capacitor 102 is charged with a voltage suited to an emission.

The electronic flash device also includes a PNP transistor 105, resistors 106 and 107, an NPN transistor 108, resistors 109 and 110 and a trigger voltage summing capacitor 111, and these elements 105 to 111 form a trigger voltage summing circuit.

The electronic flash device also includes resistors 112 and 113, an NPN transistor 114 and resistors 115 and 116, and these elements 112 to 116 form a high-speed charging circuit for both the trigger voltage summing capacitor 111 and a doubled voltage applying capacitor 133 for a Xe tube 126.

The electronic flash device also includes a resistor 117, a diode 118, a trigger capacitor 119, a resistor 120, a diode 121 and a trigger transformer 122, and these elements 117 to 122 form a trigger circuit. The electronic flash device also includes a coil 123 for limiting an emission current, a flywheel diode 124 for absorbing a voltage generated in the coil 123 when an emission is made to stop, a diode 125 for holding a voltage level difference between the trigger capacitor 119 and a power source circuit, the Xe tube 126 which constitutes emission means, an IGBT 128 which constitutes emission control means, resistors 129 and 130, and a contact terminal 131 for contact to a camera which is not shown.

The electronic flash device also includes a resistor 132, a voltage doubling capacitor 133 for applying a doubled voltage and a diode 134, and the PNP transistor 105 and these elements 132, 133 and 134 constitute a doubled voltage applying circuit for the Xe tube 126.

The microcomputer 150 includes the control output terminal CNT through which to control the charging operation of the DC/DC converter 101, an analog-to-digital conversion (A/D conversion) input terminal HV through which to monitor the voltage of the main capacitor 102, a voltage doubling operation control terminal DV, a rapid charging control output terminal QC through which to control the charging of the trigger voltage summing capacitor 111, and a gate control output terminal GATE through which to control the IGBT 128. The microcomputer 150 also includes an input terminal X through which to receive an emission instruction signal from the camera, a serial clock input terminal CLK through which to perform well-known serial communications, a serial data input terminal DI, a serial data output terminal DO, and a current output terminal CHG through which to transmit to the camera a signal indicating whether the emission of the electronic flash device is possible.

A flash emission operation will be described below with reference to FIGS. 9(*a*) to 9(*i*). The operations of various parts in the electronic flash device having the above-described construction will be described for each time t0, t1 and t2.

First, at a time t0, when a power switch which is not shown is turned on and the microcomputer 150 starts its operation, the microcomputer 150 monitors the voltage of the main capacitor 102 through the terminal HV. If the voltage of the main capacitor 102 is lower than a predetermined charged voltage, the microcomputer 150 instructs the DC/DC converter 101 to perform a charging operation, through the terminal CNT. The DC/DC converter 101 starts its boosting operation, and the voltage of the main capacitor 2 starts to rise as shown in FIG. 9(*a*). In the meantime, the trigger voltage summing capacitor 111 is charged through the resistor 117, the diode 125, the resistor 112 and the resistor 113, and the potential at the positive terminal of the trigger voltage summing capacitor 111 becomes equal to the voltage of the main capacitor 102.

Then, at a time t1, if the voltage of the main capacitor 102 reaches a predetermined voltage at which an emission is possible, the microcomputer 150 makes a current to flow out through the terminal CHG to inform the camera that the emission has become possible.

Then, at a time t2, if the voltage of the main capacitor 102 reaches an upper charged voltage, the microcomputer 150 instructs the DC/DC converter 101 to stop the charging operation, through the terminal CNT. Incidentally, even after the charging operation of the DC/DC converter 101 is stopped, a current continues to flow through elements such as the resistors 103 and 104 for monitoring the voltage of the main capacitor 2, and hence, the voltage of the main capacitor 2 lowers. If the voltage of the main capacitor 102 lowers below the predetermined voltage, the microcomputer 150 again operates the DC/DC converter 101 through the terminal CNT and performs control to maintain the predetermined voltage.

Thus, at the time t2, if the shutter button of the camera is pressed after the completion of charging of the main capacitor 102 and the terminal X is lowered to a low level, the microcomputer 150 detects that fact, starts the following flash emission operation, and performs flash photography.

The operation of the microcomputer 150 will be described below with reference to the flowchart shown in FIG. 10.

First, the microcomputer 150 detects the voltage of the main capacitor 102 at the A/D input terminal HV (S101). If the voltage of the main capacitor 102 is above the predetermined voltage, the process proceeds to Step S104 so that the trigger voltage summing circuit is made inoperative. If the voltage of the main capacitor 102 is below the predetermined voltage, the process proceeds to Step S103 so that the trigger voltage summing circuit is made operative (S102). If the voltage of the main capacitor 102 is low, the trigger voltage summing circuit is operated so that the Xe tube 126 is made to effect emission securely, whereas if the voltage of the main capacitor 102 is fully high, a spark occurs between a trigger voltage and ground owing to the occurrence of an unnecessary high voltage and the trigger voltage fails to be applied across the Xe tube 126. For this reason, the aforesaid decision step S102 and the following steps S103 and S104 are needed to prevent such lack of trigger voltage or other phenomena.

If, as shown in FIG. 9(*g*), the microcomputer 150 sets the output terminal DV to a high level so as to operate the trigger voltage summing circuit, the NPN transistor 108 is brought to an electrically conductive state, and the base current of the PNP transistor 105 flows into the NPN transistor 108 through the resistor 107, whereby the PNP transistor 105 is brought into an electrically conductive state (S103). At this time, the potential at the positive terminal of the main capacitor 102 is applied to the emitter of the PNP transistor 105 and the collector potential of the PNP transistor 105 is raised to approximately the same potential as the emitter potential. Thus, the negative terminal potential of the trigger voltage summing capacitor 111 is raised to the potential of the main capacitor 102, and the positive terminal potential of the trigger voltage summing capacitor 111 and the positive terminal potential of the trigger capacitor 119 become a potential which is 1·n times as high as a voltage VMC of the main capacitor 102, as shown by an arrow in FIG. 9(*e*). Such potential is obtained by using the following equation:

$$Vtrig=Vme+(C111/(C111+C119))\cdot Vme,$$

where vtrig denotes the positive terminal potential of the trigger capacitor 119 and Vme denotes the voltage of the main capacitor 102.

In the meantime, the negative terminal potential of the doubled voltage applying capacitor 133 relative to the Xe tube 126 is similarly raised to the same potential as the positive terminal potential of the main capacitor 102, so that the positive terminal potential of the doubled voltage applying capacitor 133 becomes a potential which is twice the voltage of the main capacitor 102, while the anode potential of the Xe tube 126 becomes a potential which is twice the voltage of the main capacitor 102.

Then, when the output terminal GATE is set to a high level as shown in FIG. 9(*h*), the IGBT 128 is brought to an electrically conductive state, and the electric charge of the trigger capacitor 119 flows through the diode 118, the IGBT 128 and the trigger transformer 122, so that a trigger voltage of several thousand volts is generated on the secondary winding side of the trigger transformer 122 to excite the Xe tube 126 to cause it to start an emission (S104).

When the emission is started, the microcomputer 150 turns off a current flowing out through the terminal CHG as shown in FIG. 9(*b*), to cause the camera to detect that the electronic flash device has started the emission. An integrating circuit (not shown) inside the camera integrates light reflected from a subject, and when the amount of light reaches a predetermined amount of emission, i.e., a predetermined integral amount, the camera sets the terminal CLK to a high level as shown in FIG. 9(*i*), to instruct the electronic flash device to stop the emission. The microcomputer 150 confirms this emission stop signal, and if the emission stop signal is at a high level, the process proceeds to Step S107, whereas if it is at a low level, the process proceeds to step S106 (S105).

Even if the emission stop signal is not supplied from the camera, i.e., the terminal CLK is at a low level, it is necessary to execute the aforesaid emission stop processing when a predetermined time passes after the emission. For this reason, the microcomputer 150 counts a period of time which elapses after the emission, and if a predetermined time has elapsed, the process proceeds to Step S107, whereas if the predetermined time has not yet elapsed, the process returns to Step S105 to repeat the aforesaid processing (S106).

After the emission stop signal from the camera (the high level at the terminal CLK) has been detected, or in the case of time-out, the microcomputer 150 executes the emission stop processing of setting the output terminal GATE to a low level as shown in FIG. 9(*h*) to turn off the IGBT 128, thereby stopping the emission (S107).

If the terminal DV is at a high level, i.e., a trigger voltage summing operation is to be performed, the process proceeds to Step S109, whereas if the terminal DV is at a low level, i.e., a trigger voltage summing operation is not to be performed, the process proceeds to Step S111 (S108)

As shown in FIG. 9(*g*), the microcomputer 150 sets the state of the output terminal DV to the low level to set the transistor 105 for controlling doubling of a trigger voltage to an electrically non-conductive state, thereby inhibiting the operation of the trigger voltage summing circuit (S109).

Then, as shown in FIG. 9(*j*), the microcomputer 150 sets the output terminal QC to a high level for a predetermined time period to hold the NPN transistor 14 in an electrically conductive state (S110). This setting is intended to rapidly charge the trigger voltage summing capacitor 111 for the next emission. FIG. 9(*e*) is a view showing the charged state of the trigger voltage summing capacitor 111. After the completion of the emission, if the NPN transistor 114 is not turned on, as shown by a dotted line in FIG. 9(*e*), the negative terminal voltage of the trigger voltage summing capacitor 111 is charged in a time period determined by the capacity of the trigger voltage summing capacitor 111 and the time constants of the charging resistors 112 and 113. However, if the NPN transistor 114 is turned on, as shown by a solid line in FIG. 9(*e*), the negative terminal voltage of the trigger voltage summing capacitor 111 can be rapidly charged in accordance with a time constant determined by the capacity of the trigger voltage summing capacitor 111 and the charging resistor 112. Accordingly, even during a high-speed repeated emission, the trigger voltage summing capacitor 111 is fully charged and it is, therefore, possible to effect a stable emission operation without causing lack of emission. At the same time, the doubled voltage applying capacitor 133 can be rapidly charged. Thus, the emission operation is completed (S111).

As described above, in the third embodiment, trigger voltage summing means formed by the trigger voltage summing capacitor 111 which can be charged to a potential higher than the voltage of the main capacitor 2 is added in place of a conventional trigger circuit which is only charged up to the same potential as the main capacitor 102, whereby a stable trigger voltage can be applied to the Xe tube 126. By using such trigger voltage summing means together with the doubled voltage applying circuit for the Xe tube 126, it is possible to prevent lack of emission and effect stable emission even if the voltage of the main capacitor 102 is low.

In addition, since the electronic flash device is provided with rapid charging means for rapidly charging the trigger capacitor and the doubled voltage applying capacitor after the completion of emission, the Xe tube can be made to effect emission stably even during a high-speed repeated emission.

Furthermore, since the operation of the trigger voltage summing means is controlled according to the voltage of the main capacitor, a stable emission can be maintained even if the voltage of the main capacitor is low. In addition, if the voltage of the main capacitor is high, the operation of the trigger voltage summing means is limited, whereby it is possible to effect safe and secure emission control which does not involve the occurrence of an unnecessary high voltage.

In the third embodiment, the operation of the trigger voltage summing means is controlled according to the voltage of the main capacitor 102, but even if the voltage of the main capacitor 102 is high, the operation of the trigger voltage summing means can, of course, be executed at all times so long as a problem such as lack of a trigger voltage does not occur. Accordingly, it is possible to realize simplified control.

Fourth Embodiment

Figure 11:
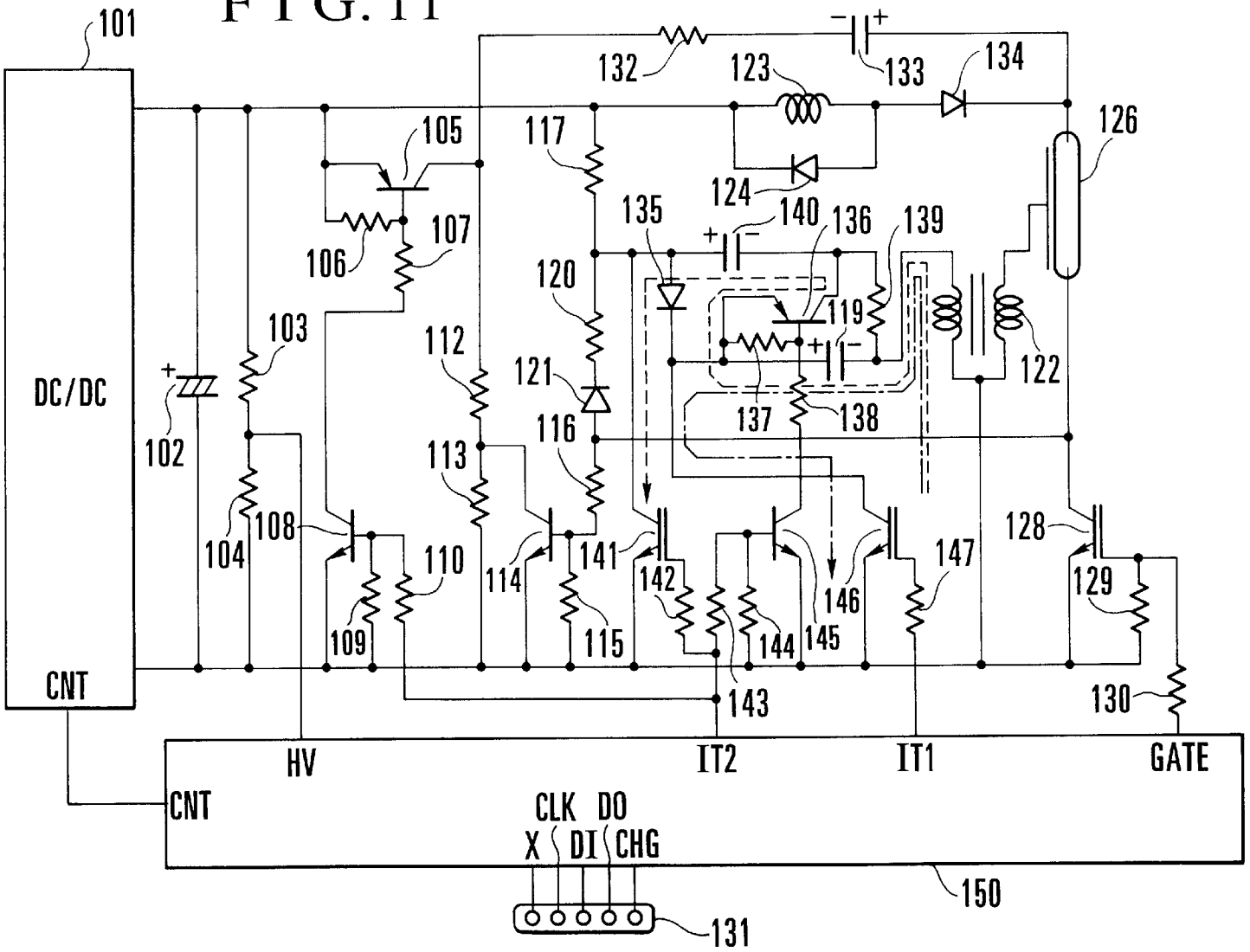
FIG. 11 is a block diagram of an electrical circuit of an electronic flash device according to a fourth embodiment of the present invention.

FIG. 11 is a block diagram showing an electrical circuit of an electronic flash device according to a fourth embodiment of the present invention.

In the third embodiment in which the trigger circuit is operated at a potential above the voltage of the main capacitor by a simple additional circuit using a trigger voltage summing capacitor, the obtained voltage addition effect does not reach twice the voltage of the main capacitor. In contrast, the fourth embodiment shown in FIG. 11 is improved so that a voltage which is twice the voltage of the main capacitor can be applied to the trigger circuit.

The electronic flash device shown in FIG. 11 includes a diode 135 for preventing a reverse current during trigger doubled voltage control, a PNP transistor 136 for applying a trigger doubled voltage, a resistor 137 across the base and the emitter of the transistor 136, a base current limiting resistor 138 for the transistor 136, a charging resistor 139 for a second trigger capacitor 140, and the second trigger capacitor 140.

The electronic flash device shown in FIG. 11 also includes an IGBT 141 which serves as trigger control means in the control operation of generating a doubled trigger voltage, a gate current limiting resistor 142 for the IGBT 142, an NPN transistor 145 for controlling the transistor 136, a base current limiting resistor 143 for the transistor 145, a resistor 144 across the base and the emitter of the transistor 145, an IGBT 146 which serves as trigger control means in the control operation of generating no doubled trigger voltage, and a gate current limiting resistor 147 for the IGBT 146. The microcomputer 150 includes a control terminal IT1 through which to control the IGBT 146 and a control terminal IT2 through which to control the IGBT 141. In FIG. 11, identical reference numerals are used to denote constituent elements identical to those shown in FIG. 8, and the description thereof is omitted.

The operation of the electronic flash device according to the fourth embodiment will be described below.

The second trigger capacitor 140 is charged in the shown polarity by the DC/DC converter 101 through the resistors 117 and 139 and the primary winding side of the trigger transformer 122. Similarly, the first trigger capacitor 119 is charged in the shown polarity through the resistor 117, the diode 135 and the trigger transformer 122.

In the following description of the subsequent operation, reference will be separately made to two different cases, i.e., the case where the voltage of the main capacitor 102 is high and the case where the voltage of the main capacitor 2 is low.

If the voltage of the main capacitor 102 is low, the microcomputer 150 outputs a high level through the terminal IT2 and a low level through the terminal IT1 so as to operate the trigger voltage summing means. Then, the transistor 145 is turned on and the transistor 136 is also turned on, and at the same time the IGBT 141 is turned on. Accordingly, a current flows through the first trigger capacitor 119, the transistor 136, the second trigger capacitor 140, the IGBT 141 and the trigger transformer 122 in accordance with a dashed line shown in FIG. 11, and a high voltage is generated on the secondary winding side of the trigger transformer 122. At this time, a voltage obtained by summing up in series the potential of the first trigger capacitor 119 and the potential of the second trigger capacitor 140 is applied to the primary winding side of the trigger transformer 122, so that a voltage which is completely twice the voltage of the main capacitor 102 is applied to the primary winding side of the trigger transformer 122.

At the same time as the above-described trigger voltage summing operation, the microcomputer 150 turns on the transistor 108 and the transistor 105 through the terminal IT2 to boost the potential of the doubled voltage applying capacitor 133, and a voltage which is twice the voltage of the main capacitor 102 is applied across the anode and the cathode of the Xe tube 126 as described previously in connection with the third embodiment. Furthermore, since the microcomputer 150 sets the output terminal GATE to the high level, the IGBT 128 is turned on to cause the aforesaid doubled voltage trigger circuit to generate a strong trigger voltage. Accordingly, even if the voltage of the main capacitor 102 is low, the electronic flash device can effect a stable emission.

Then, when the emission is to be stopped, the microcomputer 150 sets the output terminal GATE to the low level to turn off the IGBT 128, and the current which flows to the Xe tube 126 is shut off and the emission is stopped. However, since the impedance of the Xe tube 126 immediately after the stop of the emission is as low as approximately several ohms, the cathode potential of the Xe tube 126 becomes approximately equal to the anode potential of the Xe tube 126. Accordingly, the transistor 114 is turned on through the resistor 116, and as described previously in connection with the third embodiment, a rapid charging circuit is operated and the doubled voltage applying capacitor 133 is rapidly charged through the resistor 132, the resistor 112 and the transistor 114, and furthermore, the second trigger capacitor 140 is rapidly charged through the diode 121 and the resistor 120 and the first trigger capacitor 119 is rapidly charged through the diode 135. Accordingly, even during a high-speed repeated emission, the doubled voltage trigger circuit and the entire emission circuit can be stably operated.

If the voltage of the main capacitor 102 is high, the microcomputer 150 outputs a low level through the terminal IT2 and a high level through the terminal IT1 so as to bring the doubled voltage trigger circuit into an inoperative state.

When the microcomputer 150 outputs the high level through the terminal IT1, the IGBT 146 is turned on and the transistors 145 and 136 are turned off, so that a current flows through the first trigger capacitor 119, the IGBT 146 and the trigger transformer 122 as shown by a dotted and dashed line in FIG. 11, and a high voltage is generated on the secondary winding side of the trigger transformer 122. At this time, only the voltage of the first trigger capacitor 119 is applied to the primary winding side of the trigger transformer 122, so that a voltage which is the same as the voltage of the main capacitor 102 is applied to the primary winding side of the trigger transformer 122. At the same time, since the microcomputer 150 sets the output terminal GATE to the high level, the IGBT 128 is turned on to effect an emission. Incidentally, an emission stopping operation is the same as the case where the voltage of the main capacitor 102 is low, and the description thereof is omitted.

As described above, in the fourth embodiment, since trigger voltage summing means capable of applying a voltage which is twice the voltage of the main capacitor is added, a voltage which is twice the voltage of the main capacitor 2 can be used to operate the trigger circuit, whereby even if the voltage of the main capacitor is low, it is possible to prevent lack of emission and effect stable emission by using the trigger voltage summing means together with the doubled voltage applying circuit for the Xe tube.

In addition, since the electronic flash device is provided with charging means capable of effecting rapid charging after the completion of emission, the Xe tube can be made to effect emission stably even during a high-speed repeated emission.

Furthermore, since the operation of the trigger voltage summing means is controlled according to the voltage of the main capacitor, it is possible to effect safe and secure emission whether the voltage of the main capacitor is high or low.

Furthermore, it is possible to effect fast response emission control having no delay in trigger generation.

In the fourth embodiment, the operation of the trigger voltage summing means is controlled according to the voltage of the main capacitor, but even if the voltage of the main capacitor is high, the operation of the trigger voltage summing means can, of course, be executed at all times so long as a problem such as lack of a trigger voltage does not occur.

Fifth Embodiment

Figure 12:
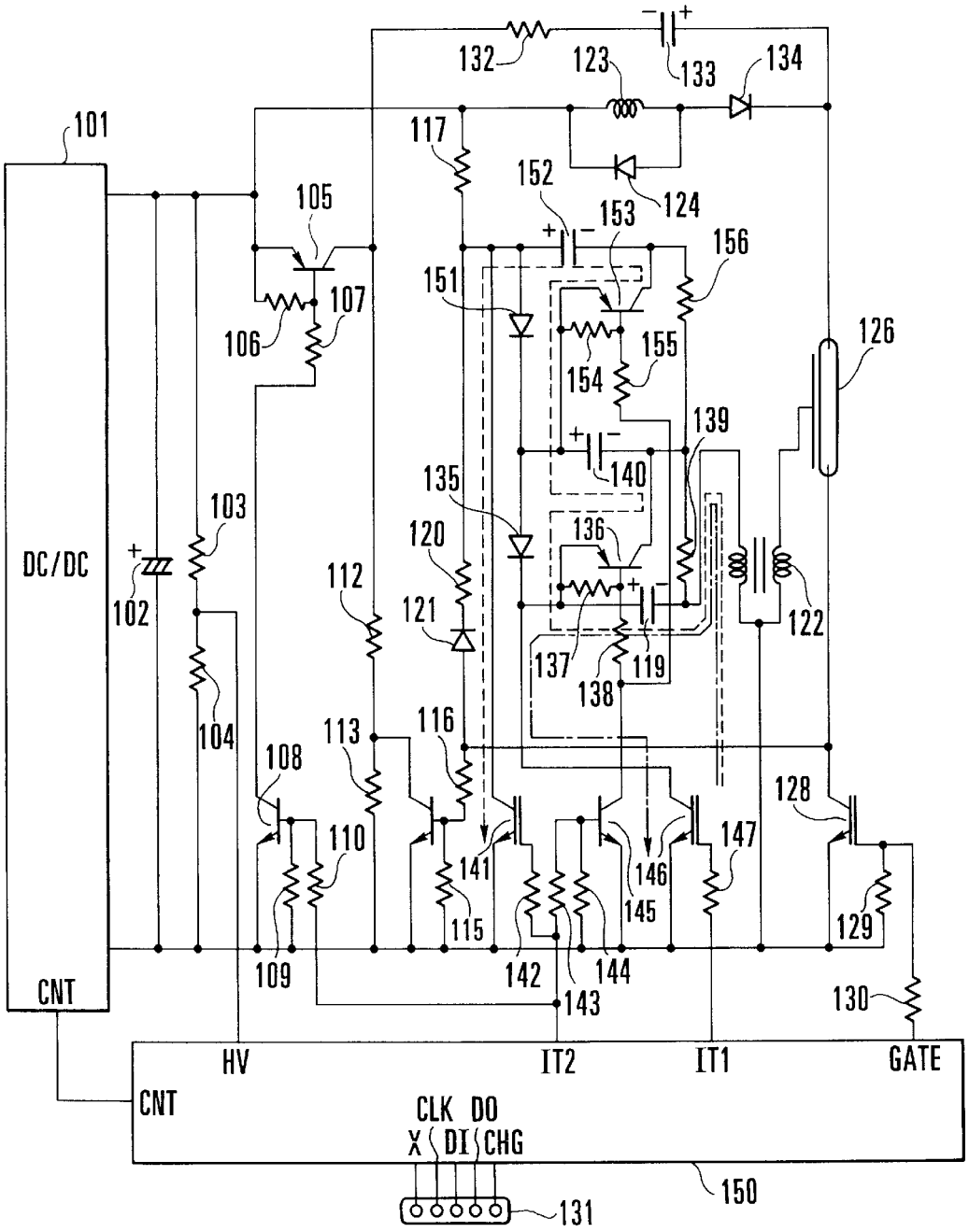
FIG. 12 is a block diagram of an electrical circuit of an electronic flash device according to a fifth embodiment of the present invention.

FIG. 12 is a block diagram showing an electrical circuit of an electronic flash device according to a fifth embodiment of the present invention. The fifth embodiment shown in FIG. 12 is a developed type of the fourth embodiment in which its trigger circuit has a construction capable of applying a voltage which is made three times the voltage of the main capacitor by summation.

The electronic flash device shown in FIG. 12 includes a diode 151 for preventing a reverse current during trigger tripled voltage control, a third trigger transistor 152, a PNP transistor 153 for applying a trigger tripled voltage, a resistor 154 across the base and the emitter of the transistor 153, a base current limiting resistor 155 for the transistor 153, and a charging capacitor 156 for the third trigger transistor 152. Incidentally, in FIG. 12, identical reference numerals are used to denote constituent elements identical to those shown in FIG. 11, and the description thereof is omitted.

The operation of the electronic flash device according to the fifth embodiment will be described below.

First, the third trigger transistor 152 is charged in the shown polarity by the DC/DC converter 101 through the resistor 117, the resistor 156, the resistor 139 and the primary winding side of the trigger transformer 122; the second trigger capacitor 140 is charged in the shown polarity through the resistor 117, the diode 151, the resistor 139 and the primary winding side of the trigger transformer 122; and the first trigger capacitor 119 is charged through the resistor 117, the diodes 151 and 135 and the trigger transformer 122 in the shown polarity.

If it is determined through the terminal HV that the voltage of the main capacitor 102 is low, the microcomputer 150 outputs a high level through the terminal IT2 and a low level through the terminal IT1 so as to operate the tripled trigger voltage summing means. Then, the transistor 145 is turned on and the transistors 136 and 153 are turned on, and at the same time the IGBT 141 is turned on. Accordingly, a current flows through the first trigger capacitor 119, the transistor 136, the second trigger capacitor 140, the transistor 153, the third trigger transistor 152, the IGBT 141 and the trigger transformer 122 in accordance with a dashed line shown in FIG. 12, and a high voltage is generated on the secondary winding side of the trigger transformer 122.

At this time, a voltage obtained by summing up the voltage of the first trigger capacitor 119, the voltage of the second trigger capacitor 140 and the voltage of the third trigger transistor 152 is applied to the primary winding side of the trigger transformer 122, so that a voltage which is three times the voltage of the main capacitor 102 is applied to the primary winding side of the trigger transformer 122.

At this time, the microcomputer 150 turns on the transistor 108 and the transistor 105 through the terminal IT2 and a voltage which is twice the voltage of the main capacitor 102 is applied across the anode and the cathode of the Xe tube 126 by a voltage doubling operation similar to that described previously in connection with the fourth embodiment. At the same time, since the microcomputer 150 sets the output terminal GATE to the high level, the IGBT 128 is turned on to cause the aforesaid tripled voltage trigger circuit to generate a strong trigger voltage. Accordingly, even if the voltage of the main capacitor 102 is low, the electronic flash device can effect a stable emission.

Then, when the emission is to be stopped, the microcomputer 150 sets the output terminal GATE to the low level to turn off the IGBT 128, and the current which flows to the Xe tube 126 is shut off and the emission is stopped. However, since the impedance of the Xe tube 126 immediately after the stop of the emission is as low as approximately several ohms, the cathode potential of the Xe tube 126 becomes approximately equal to the anode potential of the Xe tube 126. Accordingly, the transistor 114 which constitutes the rapid charging circuit is turned on through the resistor 116, and as described previously in connection with the fourth embodiment, the doubled voltage applying capacitor 133 is rapidly charged through the resistor 132, the resistor 112 and the transistor 114. At the same time, the third trigger transistor 152 is rapidly charged through the diode 121 and the resistor 120, and furthermore, the second trigger capacitor 140 is rapidly charged through the diode 151, and furthermore, the first trigger capacitor 119 is rapidly charged through the diode 135. Accordingly, even during a high-speed repeated emission, each of the doubled and tripled voltage applying circuits can be stably operated.

If the voltage of the main capacitor 102 is high, the microcomputer 150 outputs a low level through the terminal IT2 and a high level through the terminal IT1 so as to bring the doubled voltage trigger circuit into an inoperative state.

Accordingly, the transistors 145, 136 and 153 are turned off, so that a current flows through the first trigger capacitor 119, the IGBT 146 and the trigger transformer 122 as shown by a dotted and dashed line in FIG. 12, and a high voltage is generated on the secondary winding side of the trigger transformer 122. At this time, only the voltage of the first trigger capacitor 119 is applied to the primary winding side of the trigger transformer 122, so that a voltage which is the same as the voltage of the main capacitor 102 is applied to the primary winding side of the trigger transformer 122. At the same time, since the microcomputer 150 sets the output terminal GATE to the high level, the IGBT 128 is turned on to effect an emission. Incidentally, an emission stopping operation is the same as the case where the voltage of the main capacitor 102 is low, and the description thereof is omitted.

As described above, in the fifth embodiment, since trigger voltage summing means capable of applying a voltage which is three times the voltage of the main capacitor is added, a voltage which is three times the voltage of the main capacitor can be used to operate the trigger circuit, whereby even if the voltage of the main capacitor 102 is low, it is possible to prevent lack of emission and effect stable emission by using the trigger voltage summing means together with the doubled voltage applying circuit for the Xe tube 126.

In addition, since the electronic flash device is provided with charging means capable of effecting rapid charging after the completion of emission, the Xe tube can be made to emit stably even during a high-speed repeated emission.

Furthermore, since the operation of the trigger voltage summing means is controlled according to the voltage of the main capacitor, it is possible to effect safe and secure emission whether the voltage of the main capacitor is high or low.

In the fifth embodiment, the operation of the trigger voltage summing means is controlled according to the voltage of the main capacitor, but even if the voltage of the main capacitor is high, the operation of the trigger voltage summing means can, of course, be executed at all times so long as a problem such as lack of a trigger voltage does not occur.

I claim:

1. An electronic flash device comprising:

a main capacitor to be charged by a power source circuit;

a flash tube which discharges electricity with an electric charge stored in said main capacitor;

a trigger capacitor to be charged by the power source circuit;

a trigger circuit which applies a trigger signal to said flash tube by discharging an electric charge stored in said trigger capacitor into a coil of a trigger transformer; and a trigger voltage control circuit which makes a voltage of said trigger capacitor higher than a voltage of said main capacitor.

2. An electronic flash device according to claim 1, wherein said trigger voltage control circuit includes a trigger voltage summing capacitor to be charged by the power source circuit and a switching element which connects in series said trigger voltage summing capacitor and said main capacitor, a terminal of said trigger voltage summing capacitor opposite to a terminal thereof which is connected to said main capacitor being connected to said trigger capacitor.

3. An electronic flash device according to claim 1, wherein said trigger voltage control circuit has a first mode for varying the voltage of said trigger capacitor to a first voltage higher than the voltage of said main capacitor and a second mode for varying the voltage of said trigger capacitor to a second voltage lower than the first voltage.

4. An electronic flash device according to claim 3, further comprising a selecting circuit for selecting the first or second mode according to a charged voltage of said main capacitor.

5. An electronic flash device according to claim 2, wherein a negative terminal of said trigger voltage summing capacitor and a positive terminal of said main capacitor are connected to each other by said switching element, and a positive terminal of said trigger voltage summing capacitor is connected to a positive terminal of said trigger capacitor.

6. An electronic flash device according to claim 5, wherein there is provided an inhibiting mode for inhibiting said switching element from connecting said main capacitor and said trigger voltage summing capacitor.

7. An electronic flash device according to claim 6, wherein the inhibiting mode is selected according to a charged voltage of said main capacitor.

8. An electronic flash device according to claim 1, further comprising a first charging path which serves as a charging path for effecting charging of said trigger capacitor, and a second charging path having a time constant smaller than a time constant of said first charging path, said second charging path being formed to serve as a charging path after an emission.

9. An electronic flash device according to claim 1, further comprising a summing main capacitor to be charged by the power source circuit, a sum value of a voltage of said summing main capacitor and a voltage of said main capacitor being applied to said flash tube.

10. An electronic flash device according to claim 9, further comprising a selecting circuit for selecting execution or non-execution of a voltage summing operation of said summing main capacitor according to a charged voltage of said main capacitor.

11. An electronic flash device according to claim 9, wherein after said summing main capacitor has been charged, a negative terminal of said summing main capacitor is connected to a positive terminal of said main capacitor and a positive terminal of said summing main capacitor is connected to a positive terminal of said flash tube, by switch means.

12. An electronic flash device comprising:

a main capacitor to be charged by a power source circuit;

a flash tube which discharges electricity with an electric charge stored in said main capacitor;

a plurality of capacitors as a trigger capacitor to be charged by the power source circuit;

switch means which connects in series said plurality of capacitors after said plurality of capacitors have been charged;

a trigger transformer; and a trigger voltage control circuit arranged to apply to the trigger transformer a voltage obtained by summing up voltages of said plurality of capacitors connected in series.

13. An electronic flash device according to claim 12, wherein a positive terminal of each of said plurality of capacitors is connected to a negative terminal of the next one by said switch means so that the voltages of said plurality of capacitors are summed up.

14. An electronic flash device according to claim 13, wherein there is provided an inhibiting mode for inhibiting said switch means from connecting said plurality of capacitors.

15. An electronic flash device according to claim 14, wherein the inhibiting mode is selected according to a charged voltage of said main capacitor.

16. An electronic flash device comprising:

a plurality of capacitors to be individually charged by a power source circuit;

a flash tube which discharges electricity with an electric charge stored in said capacitors;

a voltage application control circuit for applying a sum value of voltages of said capacitors to said flash tube; and an inhibiting circuit for inhibiting a voltage summing operation of said voltage application control circuit according to a charged voltage of one of said plurality of capacitors.

17. An electronic flash device according to claim 16, wherein said capacitors are first and second main capacitors and said voltage application control circuit is a switch element for connecting a positive terminal of said first main capacitor and a negative terminal of said second main capacitor after each of said capacitors has been charged, a positive terminal of said second main capacitor being connected to a positive terminal of said flash tube.

18. An electronic flash device according to claim 17, wherein said inhibiting circuit inhibits said switch element from connecting said first and second main capacitors.

* * * * *

UNITED STATES PATENT AND TRADEMARK OFFICE

CERTIFICATE OF CORRECTION

PATENT NO. : 6,034,486
DATED : March 7, 2000
INVENTOR(S) : Hajime Fukui

It is certified that error appears in the above-identified patent and that said Letters Patent is hereby corrected as shown below:

Column 13,
Line 61, delete “vtrig” and insert -- Vtrig --.

Column 14,
Line 48, after “(S108)” insert -- . --.

Signed and Sealed this

Fourteenth Day of January, 2003

JAMES E. ROGAN
*Director of the United States Patent and Trademark Office*